US008605145B2

(12) United States Patent
Webster et al.

(10) Patent No.: US 8,605,145 B2
(45) Date of Patent: Dec. 10, 2013

(54) INSPECTION SYSTEM AND INSPECTION PROCESS UTILIZING MAGNETIC INSPECTION VEHICLE

(75) Inventors: Brian Webster, Ontario, NY (US); Nathan Bates, Newark, NY (US); Bryan Pudlo, Webster, NY (US)

(73) Assignee: R. Brooks Associates, Inc., Williamson, NY (US)

( * ) Notice: Subject to any disclaimer, the term of this patent is extended or adjusted under 35 U.S.C. 154(b) by 295 days.

(21) Appl. No.: 12/714,090

(22) Filed: Feb. 26, 2010

(65) Prior Publication Data

US 2011/0169938 A1 Jul. 14, 2011

Related U.S. Application Data

(60) Provisional application No. 61/156,121, filed on Feb. 27, 2009.

(51) Int. Cl.
*H04N 7/18* (2006.01)

(52) U.S. Cl.
USPC ..... 348/82; 15/3

(58) Field of Classification Search
USPC ..... 348/82; 73/623; 318/568.12; 291/41
See application file for complete search history.

(56) References Cited

U.S. PATENT DOCUMENTS

| | | | | |
|---|---|---|---|---|
| 4,010,636 | A | 3/1977 | Clark et al. | |
| 4,654,702 | A | 3/1987 | Tolino | |
| 5,062,301 | A | 11/1991 | Aleshin et al. | |
| 5,187,664 | A * | 2/1993 | Yardley et al. | 701/23 |
| 5,254,944 | A * | 10/1993 | Holmes et al. | 324/220 |
| 5,285,689 | A | 2/1994 | Hapstack et al. | |
| 5,853,655 | A | 12/1998 | Baker | |
| 6,414,458 | B1 | 7/2002 | Hatley et al. | |
| 6,588,808 | B1 * | 7/2003 | Sheppard | 291/41 |
| 2002/0074965 | A1 * | 6/2002 | Hatley et al. | 318/568.12 |
| 2006/0027952 | A1 * | 2/2006 | Meissner et al. | 266/67 |

FOREIGN PATENT DOCUMENTS

| | | |
|---|---|---|
| JP | 6-347407 A | 12/1994 |
| JP | 11-94179 A | 4/1999 |

OTHER PUBLICATIONS

PCT/US10/0025610 Written Opinion; mailed Aug. 15, 2011; 5 pages.
PCT/US10/0025610 Written Opinion; mailed Apr. 23, 2010; 8 pages.
PCT/US10/0025610 International Search Report; mailed Apr. 23, 2010; 3 pages.
Affidavit of Bradley DeLaCroix, Dated Jul. 18, 2013 (2 pages).
Affidavit of Bradley DeLaCroix, Dated Jul. 18, 2013 (10 pages).

* cited by examiner

*Primary Examiner* — Sath V Perungavoor
*Assistant Examiner* — Dakshesh Parikh
(74) *Attorney, Agent, or Firm* — Nixon Peabody LLP

(57) ABSTRACT

An inspection vehicle configured to inspect steam generators includes a front chassis having two independently driven magnetic wheels, a rear chassis having two independently driven magnetic wheels, and a connecting member flexibly connecting the front chassis to the rear chassis to permit relative motion between the front chassis and the rear chassis along at least one axis. The connecting member, front chassis, and rear chassis collectively define a receiving area. The inspection vehicle also includes a navigation camera disposed on the front chassis and a pan and tilt inspection camera assembly including a first rotatable arm driven by a first motor, a second rotatable arm disposed on a distal portion of the first rotatable arm, the second rotatable arm being driven by a second motor, and an inspection camera rotatably disposed on a distal portion of the second arm, the inspection camera being driven by a third motor, the camera assembly being dimensioned to be received within the receiving area in a stowed position.

26 Claims, 24 Drawing Sheets

INSPECTION SYSTEM AND INSPECTION PROCESS UTILIZING MAGNETIC INSPECTION VEHICLE

CLAIM TO PRIORITY

This application claims priority from 61/156,121, filed on Feb. 27, 2009, which is incorporated by reference herein in its entirety.

FIELD OF THE INVENTION

This invention relates to a method and apparatus for inspecting a steam generator and, more particularly, to a method and apparatus for remotely inspecting steam generator internals.

BACKGROUND OF THE INVENTION

In a pressurized water reactor (PWR), the heat generated by the nuclear reaction on the primary side is passed to reactor coolant. The reactor coolant is, in turn, passed into a hot leg of a steam generator (e.g., a Westinghouse Model 51 steam generator), moves through U-tubes (the "tube bundle") in the steam generator (passing heat into water on the secondary side of steam generator), and passes out through a "cold" leg of the steam generator to return to the reactor to complete and perpetuate the loop.

The PWR steam generator typically is an upright cylindrical pressure vessel with hemispherical end sections, clad on internal surfaces with austenitic stainless steel. A transverse plate, a tubesheet, is disposed at a lower end of the cylindrical section, dividing the steam generator into a primary side, which is the lower hemispherical section below the tubesheet, and a secondary side above the tubesheet. Two 16 inch diameter manways permit access for inspection and maintenance during outage periods. A vertical wall bisects the primary side into an inlet section and an outlet section. The tubesheet also supports the U-tubes, noted above, at their lower ends. The tubesheet comprises thousands of holes (e.g., 11,252 holes) on the inlet section and the outlet section with one end of each U-tube inserted into a hole on the inlet section and the other end of the U-tube inserted into a hole at the outlet section (e.g., 5,626 tubes). Thus, each U-tube communicates, on one end, with the inlet section of the primary side, and the other end communicates with the outlet section of the primary side. The U-tubes are supported at various elevations above the tubesheet by support plates (e.g., seven tube support plates, roughly 1 inch thick and spaced about 39 inches apart). Tube support plates comprise openings for each U-tube, such support plates comprising, for example, an egg crate type configuration or a quatrefoil (cloverleaf shaped) configuration, with the support plates are themselves supported by tie rods and the steam generator cylindrical wrapper. Two small handholes are located above the tubesheet to provide limited access to the secondary side of the tubesheet.

The steam generator cylindrical wrapper, noted above, is disposed between the tube bundle and the steam generator shell and defines therebetween an annular "downcomer" chamber, terminating a predetermined distance above the tube sheet. A secondary fluid ("feedwater") is introduced into an upper portion of the secondary side of the steam generator to travel down the annular chamber formed between the inner surface of the steam generator cylinder and the outside surface of the steam generator wrapper and to the tube sheet, radially inwardly along the tube sheet and upwardly among the U-tubes tubes inside the wrapper to circulate around the U-tubes, above the tubesheet, in a heat transfer relationship with the outside of the U-tubes. Owing to this heat transfer, a portion of the feedwater is converted to steam and the steam is then passed to steam turbines to generate power.

There are various mechanisms that are recognized to cause degradation of the safety of the barrier between the primary side and the secondary side and/or the efficiency of transfer of heat from the primary side to the secondary side, such as general corrosion, intergranular corrosion, pitting, and stress corrosion cracking (SCC), fretting, denting, etcetera.

Title 10 of the Code of Federal Regulations (10 CFR) establishes the fundamental regulatory requirements with respect to the integrity of the steam generator U-tubes, stating in the general design criteria (GDC) in Appendix A of 10 CFR Part 50 that the reactor coolant pressure boundary (RCPB) between the primary side and the secondary side shall be "designed, fabricated, erected, and tested so as to have an extremely low probability of abnormal leakage, of rapidly propagating failure, and of gross rupture" (GDC 14), shall be "designed, fabricated, erected, and tested to the highest quality standards practical" (GDC 30), and shall be "designed to permit periodic inspection and testing of important areas and features to assess their structural and leaktight integrity" (GDC 32). Given the importance of steam generator tube integrity, PWR licensees have technical specifications governing the surveillance of steam generator U-tubes, but such technical specifications typically do not prescribe nondestructive test methods for inspecting tubes or specify where a particular methodology should be used, as is noted in Generic Letter (GL) 2004-01 issued by the U.S. Nuclear Regulatory Commission. As further noted therein, steam generator U-tubes are also subject to the quality assurance requirements of 10 CFR Part 50, Appendix B. Notwithstanding that the technical specifications (TS) do not specify nondestructive test methods or in what locations particular test methods must be employed, Criterion IX of 10 CFR Part 50, Appendix B, "Control of Special Processes," requires, in part, that nondestructive testing be controlled and accomplished by qualified personnel using qualified procedures in accordance with applicable codes, standards, specifications, criteria, and other special requirements.

NRC Generic Letter 97-06 deals with steam generator U-tube integrity and failure mechanisms related to U-tube support degradation including, for example, corrosion-based degradation of steam generator tube eggcrate supports, discovered through secondary side visual inspections performed during an outage. NRC Generic Letter 97-05 also dealt with steam generator tube inspection techniques. Earlier, NRC Information Notice (IN) 79-27 highlighted the potential of steam generator U-tube ruptures as a result of foreign material in the secondary side of steam generators. Guidance on steam generator inspection is provided by Electric Power Research Institute (EPRI) guidelines and NEI 97-06, which is a generic self imposed industry guideline that lays out inspection, maintenance and repair criteria for steam generators.

To satisfy such requirements and guidelines, inspections were previously carried out by manually pushing video probes into the steam generator, which was and is disadvantageously radiation dose intensive (requires worker protection and limitation of exposure time), or by using inspection crawlers, which could inspect the annulus region, but could not inspect the annular region and the in-bundle high-flow region between the tubesheet and the first tube support.

SUMMARY OF THE INVENTION

According to one aspect of the present invention, an inspection vehicle configured to inspect steam generators includes a front chassis having two independently driven magnetic wheels, a rear chassis having two independently driven magnetic wheels, and a connecting member flexibly connecting the front chassis to the rear chassis to permit relative motion between the front chassis and the rear chassis along at least one axis. The connecting member, front chassis, and rear chassis collectively define a receiving area. The inspection vehicle also includes a navigation camera disposed on the front chassis and a pan and tilt inspection camera assembly including a first rotatable arm driven by a first motor, a second rotatable arm disposed on a distal portion of the first rotatable arm, the second rotatable arm being driven by a second motor, and an inspection camera rotatably disposed on a distal portion of the second arm, the inspection camera being driven by a third motor, the camera assembly being dimensioned to be received within the receiving area in a stowed position.

According to another aspect of the invention, an inspection vehicle configured to inspect steam generators includes a front chassis comprising two independently driven magnetic wheels, wherein the magnetic wheels are offset from one another, and a rear chassis comprising two independently driven magnetic wheels, wherein the magnetic wheels are offset from one another. A hinge flexibly connects the front chassis to the rear chassis to permit relative angular motion between the front chassis and the rear chassis. The connecting member, front chassis, and rear chassis collectively define a receiving area into which a pan and tilt inspection camera assembly is configured to be stowed. The pan and tilt inspection camera assembly comprises a first rotatable arm driven by a first motor, a second rotatable arm disposed on a distal portion of the first rotatable arm, the second rotatable arm being driven by a second motor, and an inspection camera rotatably disposed on a distal portion of the second arm, the inspection camera being driven by a third motor. The inspection vehicle further comprises an auto-orientation circuit configured to automatically orient the inspection vehicle to a set orientation.

According to yet another aspect of the invention, a method for inspecting a secondary side of a steam generator is provided and comprises the acts of inserting through a handhole on the secondary side of the steam generator an inspection vehicle, the inspection vehicle comprising a front chassis comprising two independently driven magnetic wheels, a rear chassis comprising two independently driven magnetic wheels, a hinge flexibly connecting the front chassis to the rear chassis to permit relative angular motion between the front chassis and the rear chassis, a receiving area defined by the connecting member, the front chassis, and the rear chassis, a pan and tilt inspection camera assembly comprising a first rotatable arm driven by a first motor, a second rotatable arm disposed on a distal portion of the first rotatable arm, the second rotatable arm being driven by a second motor, and an inspection camera rotatably disposed on a distal portion of the second arm, the inspection camera being driven by a third motor, the camera assembly being dimensioned to be received within the receiving area in a stowed position, and an auto-orientation circuit configured to automatically orient the inspection vehicle to a set orientation. The method further comprises the acts of moving the inspection vehicle to an initial row of U-tubes, panning the inspection camera between the tubesheet and the flow distribution baffle to inspect the tubesheet, U-tubes, and flow distribution baffle, moving the inspection vehicle forward one row to a next row of U-tubes, and panning the inspection camera between the flow distribution baffle and the tubesheet to inspect the tubesheet, U-tubes, and flow distribution baffle. In accord with this method, the acts of moving and panning are sequentially repeated.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 1*l* shows a first side view of the embodiment of the present invention as depicted in FIGS. 1*i*-1*k*.

Figure 1A:
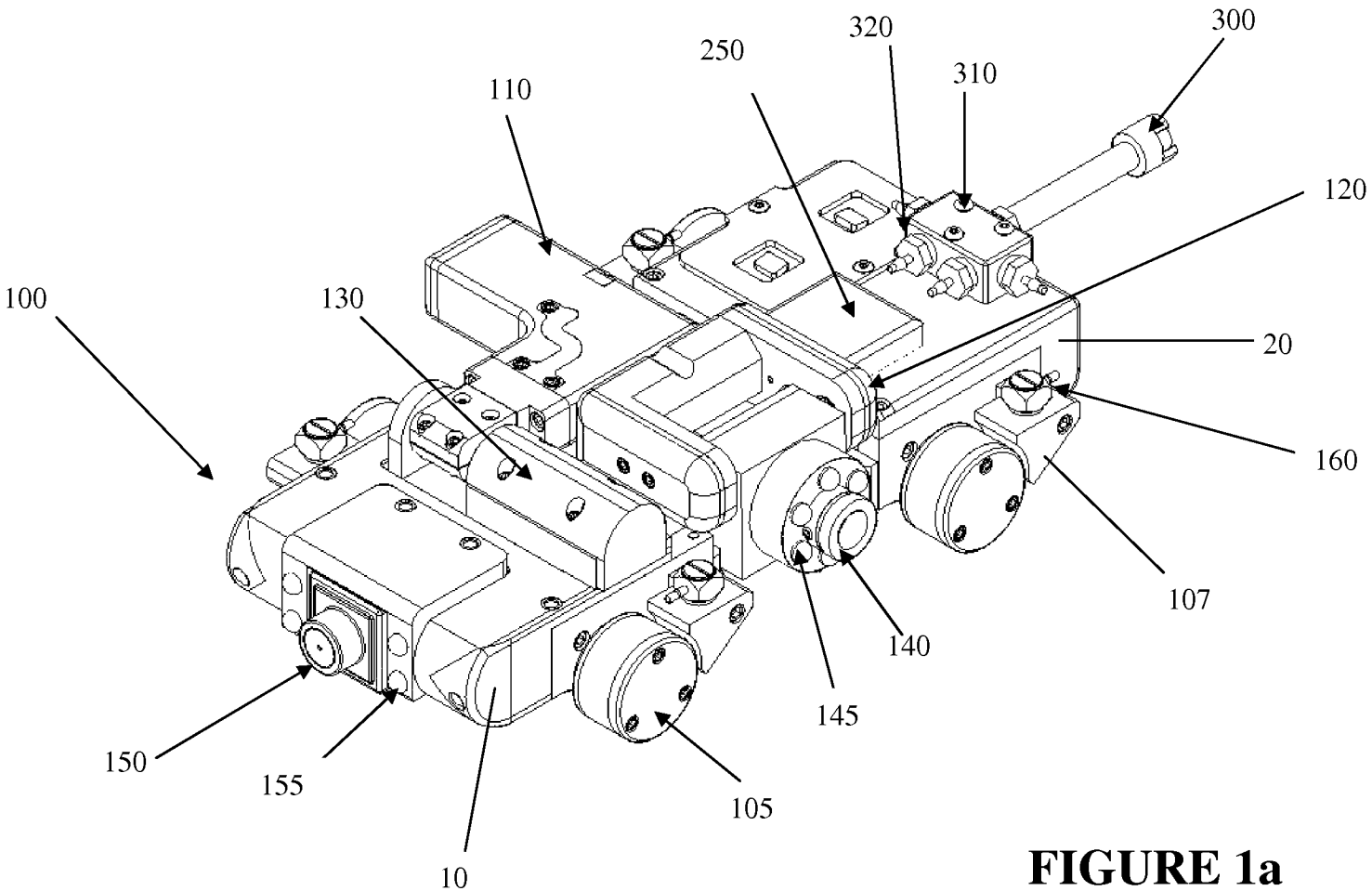
FIG. 1*a* is a perspective view of an embodiment of the present invention with a camera assembly in a stowed configuration.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
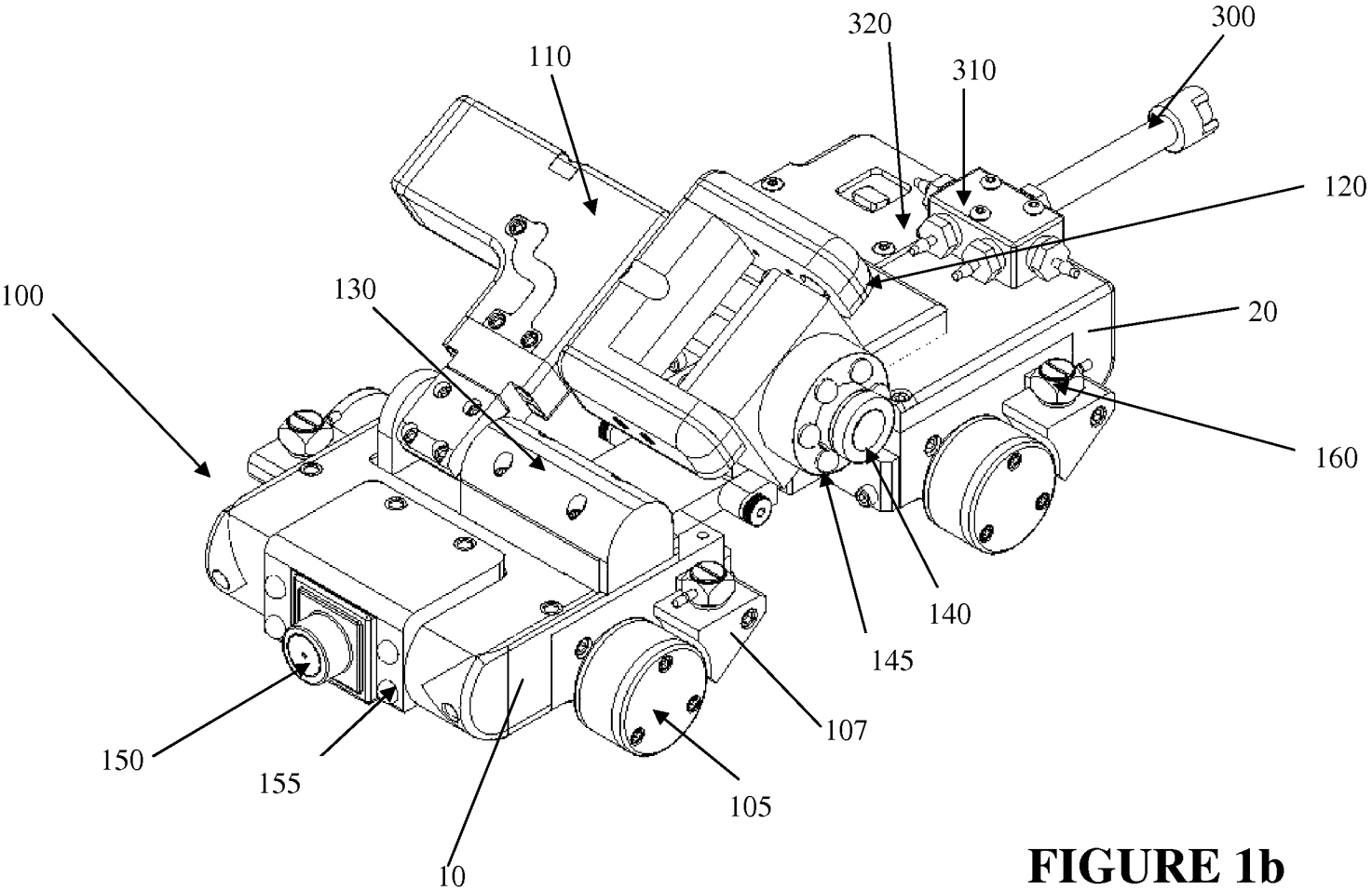
FIG. 1*b* is another perspective view of the embodiment of the present invention depicted in FIG. 1*a*, with the camera assembly in a first configuration.
Figure 1C:
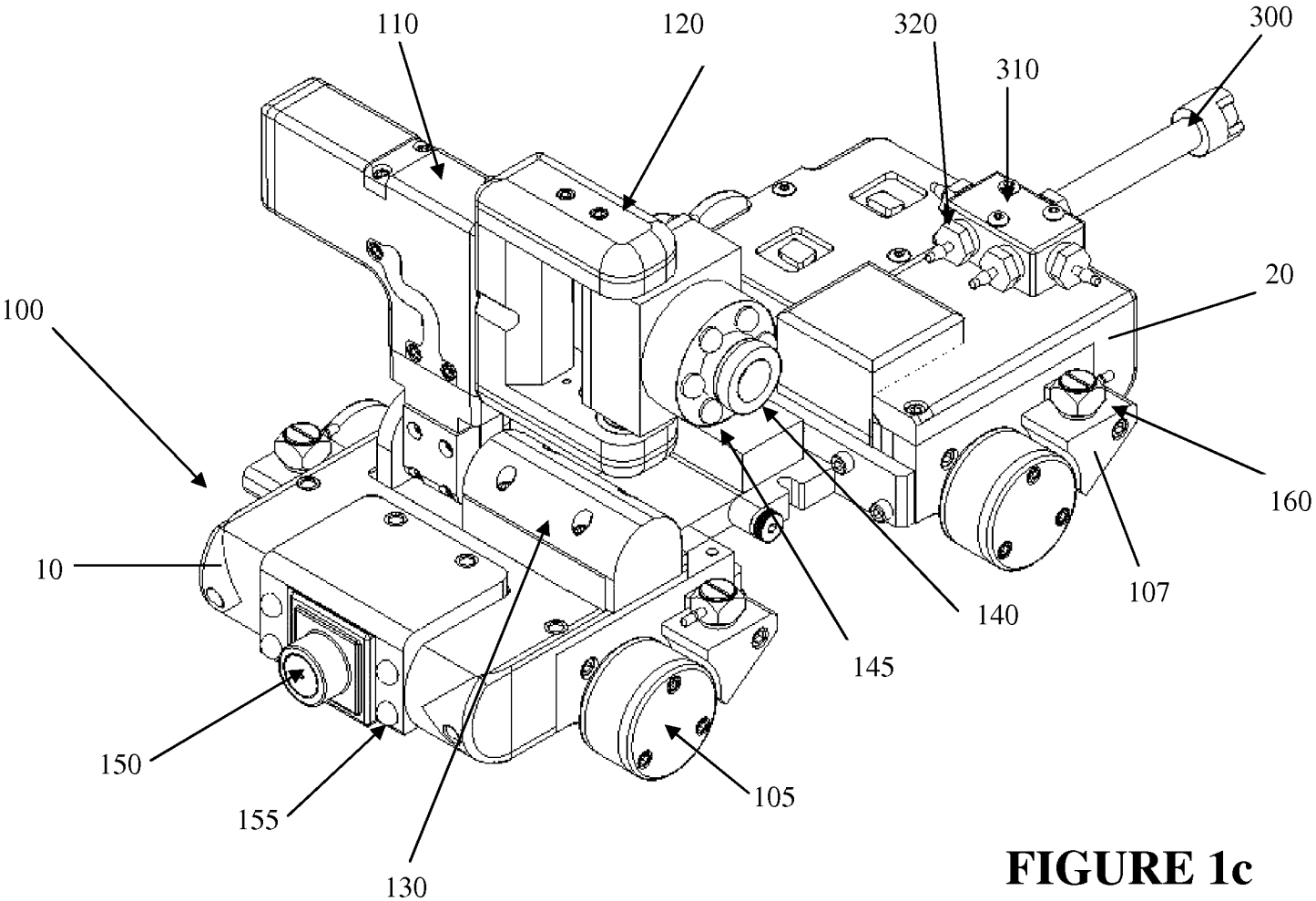
FIG. 1*c* is another perspective view of the embodiment of the present invention depicted in the preceding figures, with the camera assembly in a second configuration.
Figure 1D:
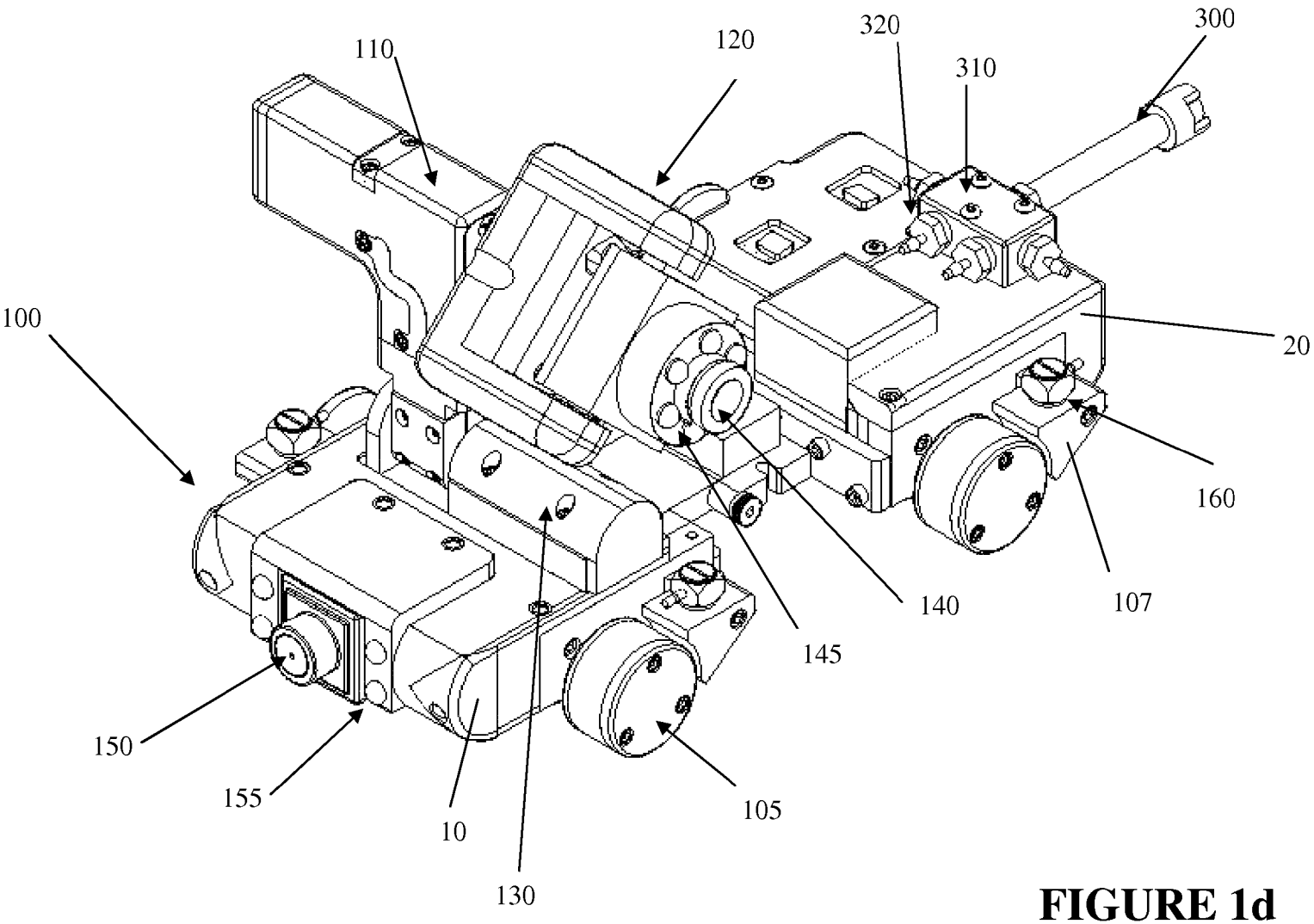
FIG. 1*d* is another perspective view of the embodiment of the present invention depicted in the preceding figures, with the camera assembly in a third configuration.
Figure 1E:
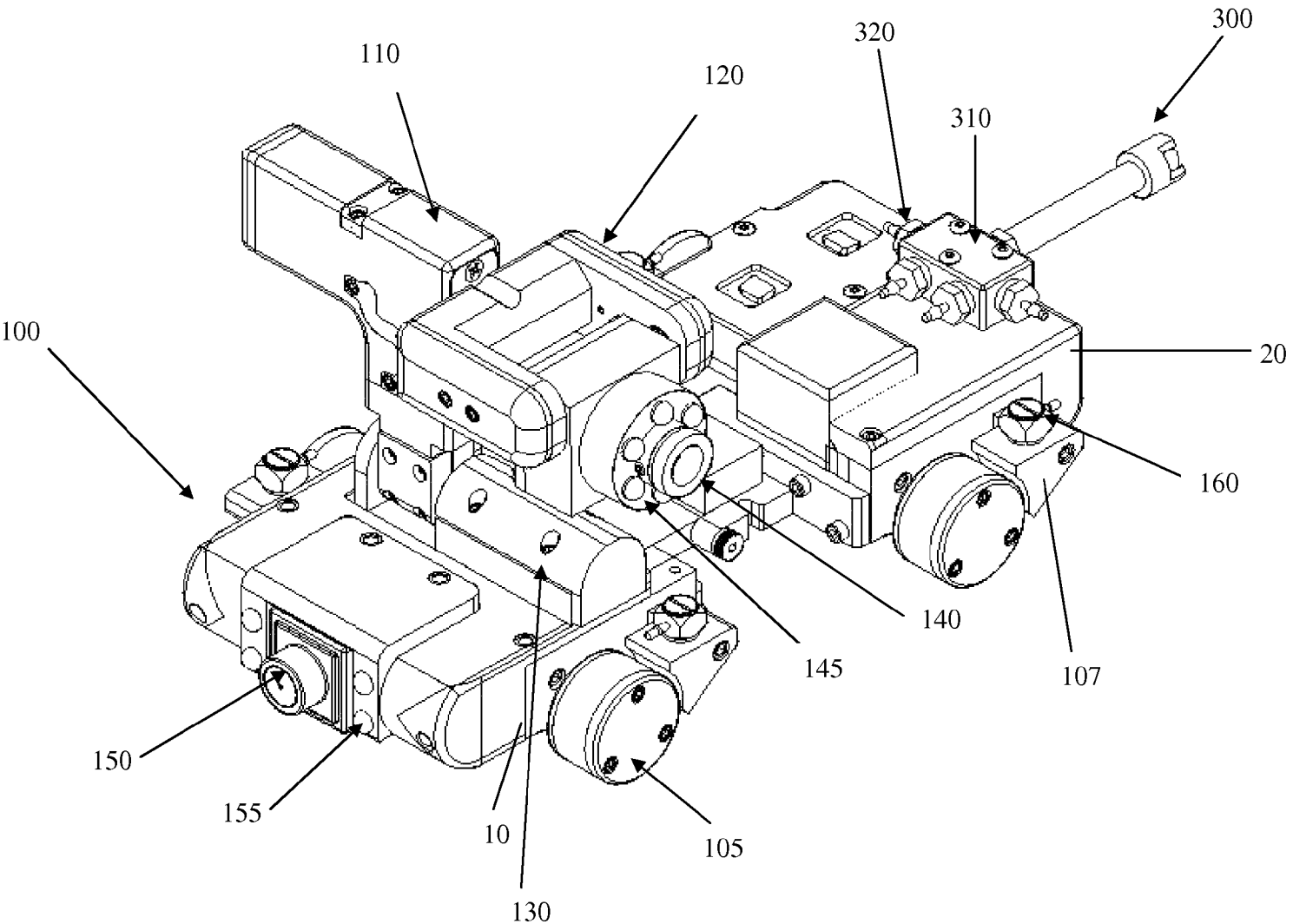
FIG. 1*e* is another perspective view of the embodiment of the present invention depicted in the preceding figures, with the camera assembly in a fourth configuration.
Figure 1F:
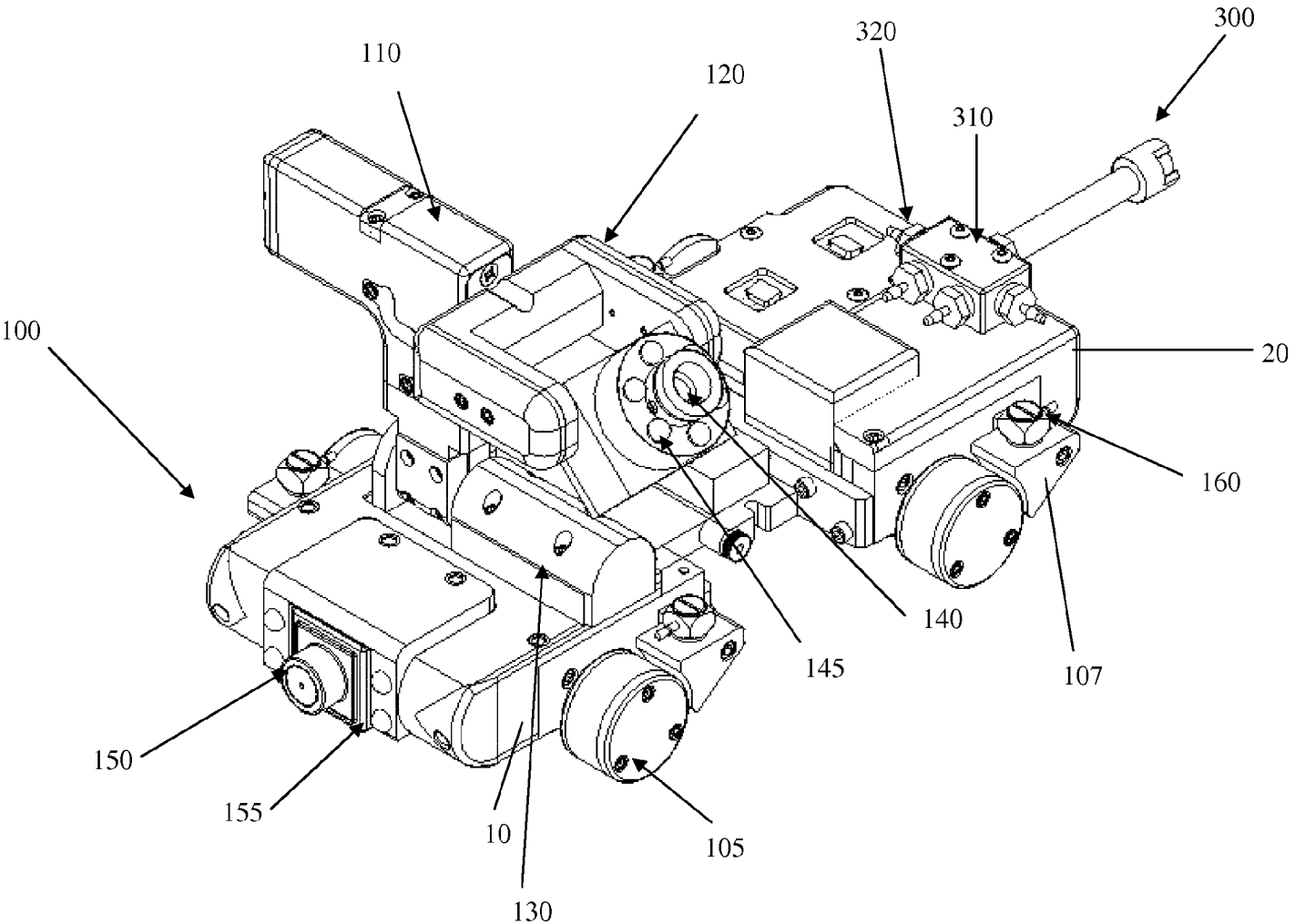
FIG. 1*f* is another perspective view of the embodiment of the present invention depicted in the preceding figures, with the camera assembly in a fifth configuration.
Figure 1G:
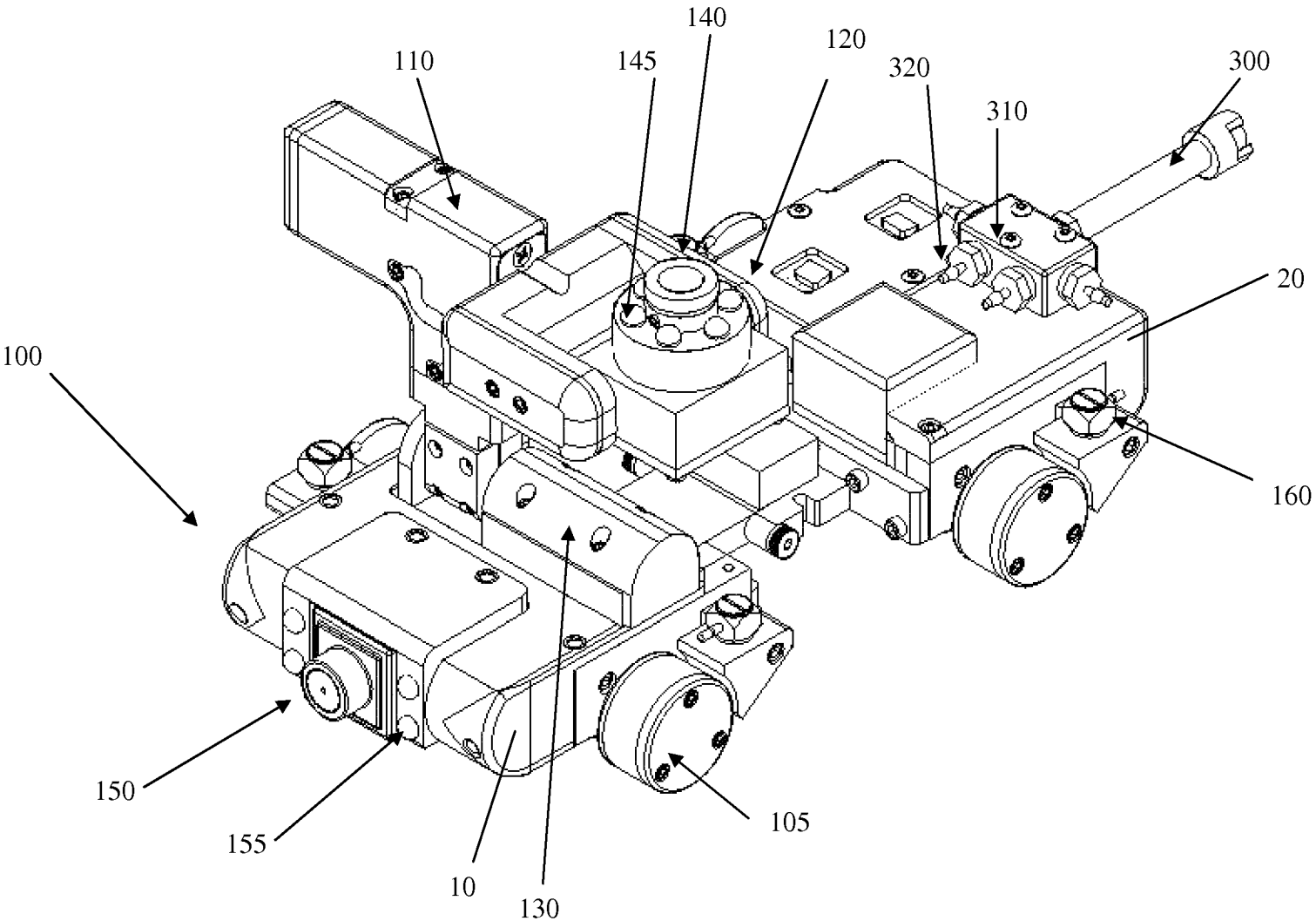
FIG. 1*g* is another perspective view of the embodiment of the present invention depicted in the preceding figures, with the camera assembly in a sixth configuration.
Figure 1H:
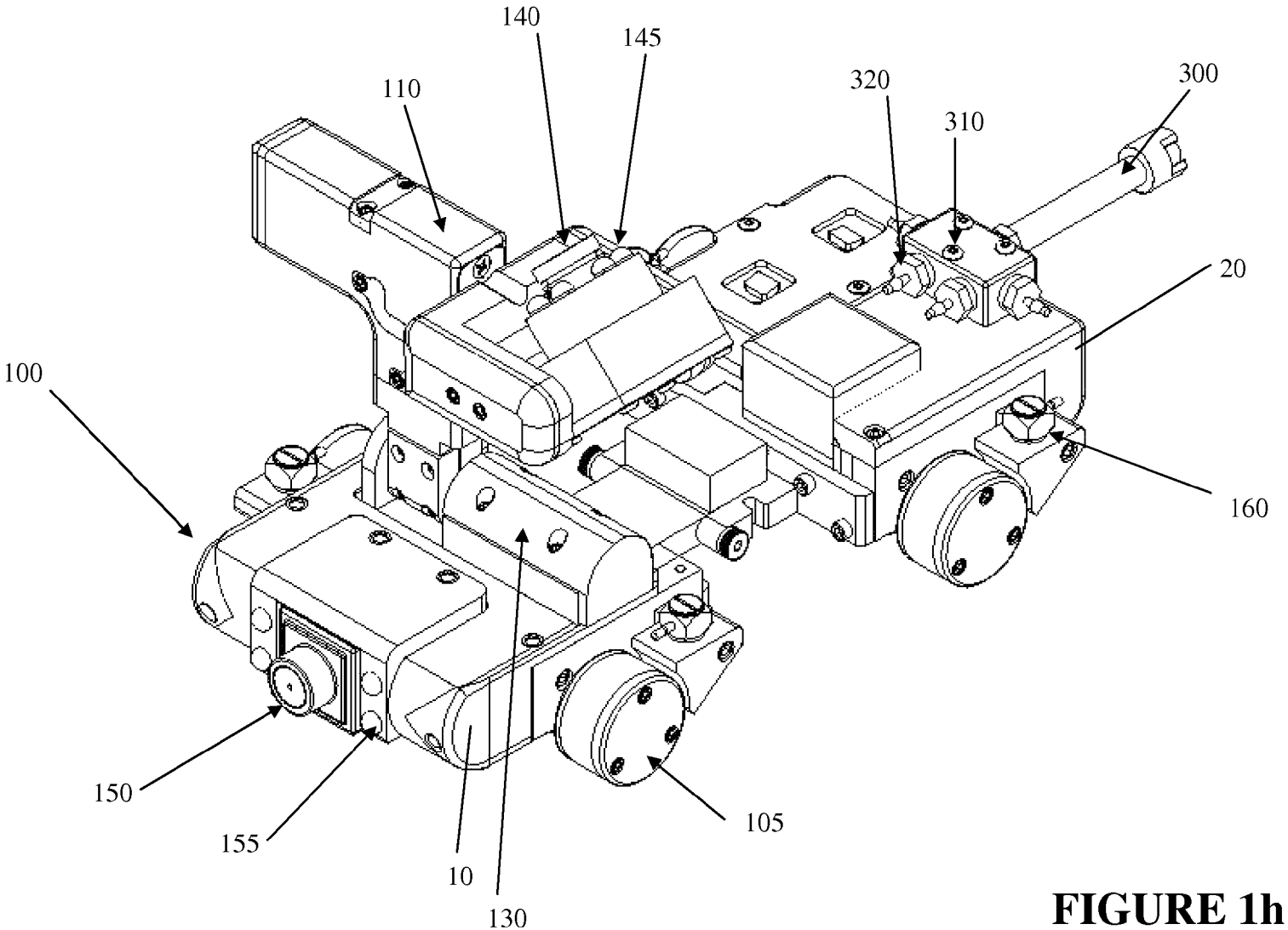
FIG. 1*h* is another perspective view of the embodiment of the present invention depicted in the preceding figures, with the camera assembly in a seventh configuration.
Figure 1I:
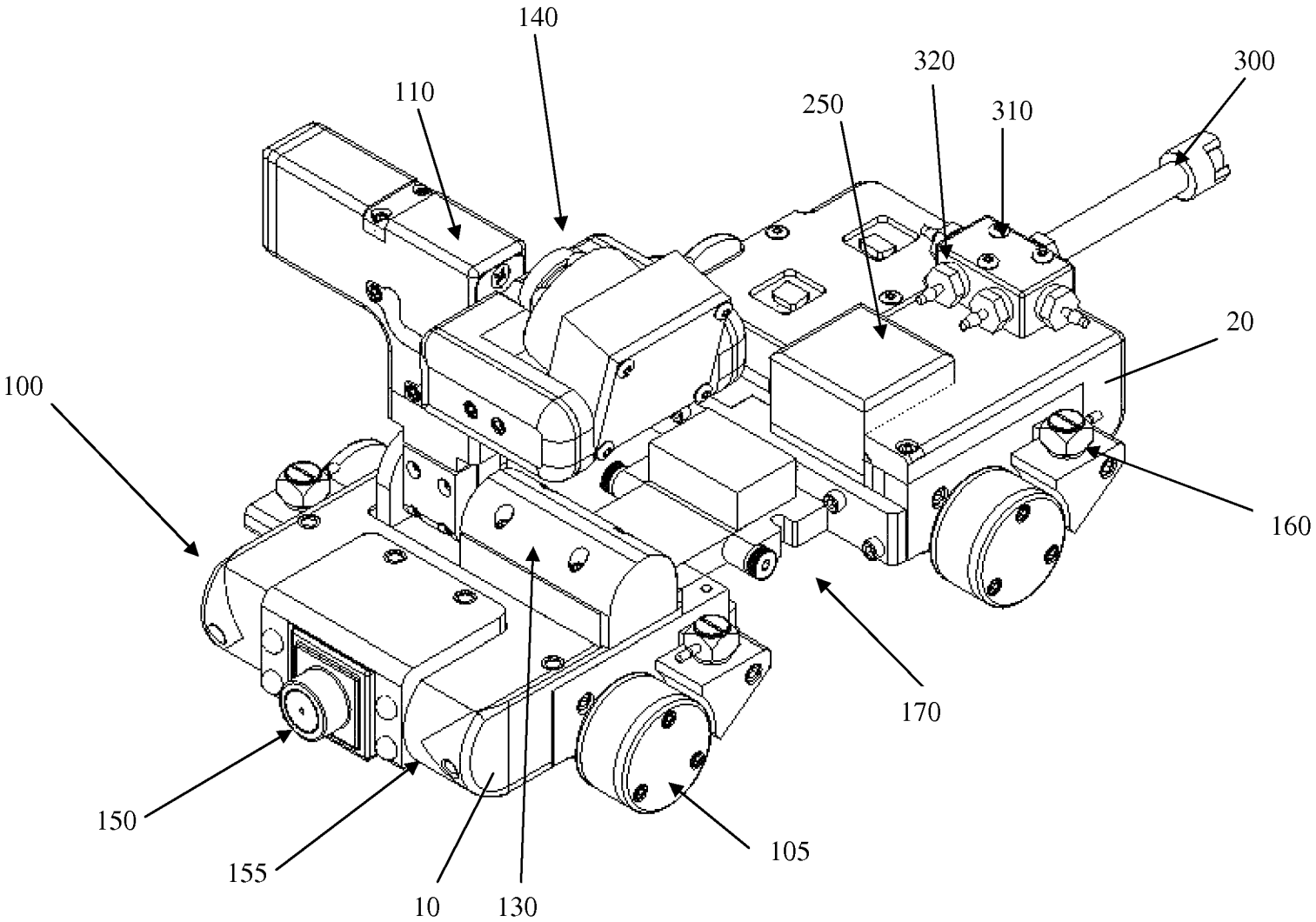
FIG. 1*i* is another perspective view of the embodiment of the present invention depicted in the preceding figures, with the camera assembly in an eighth configuration.
Figure 1J:
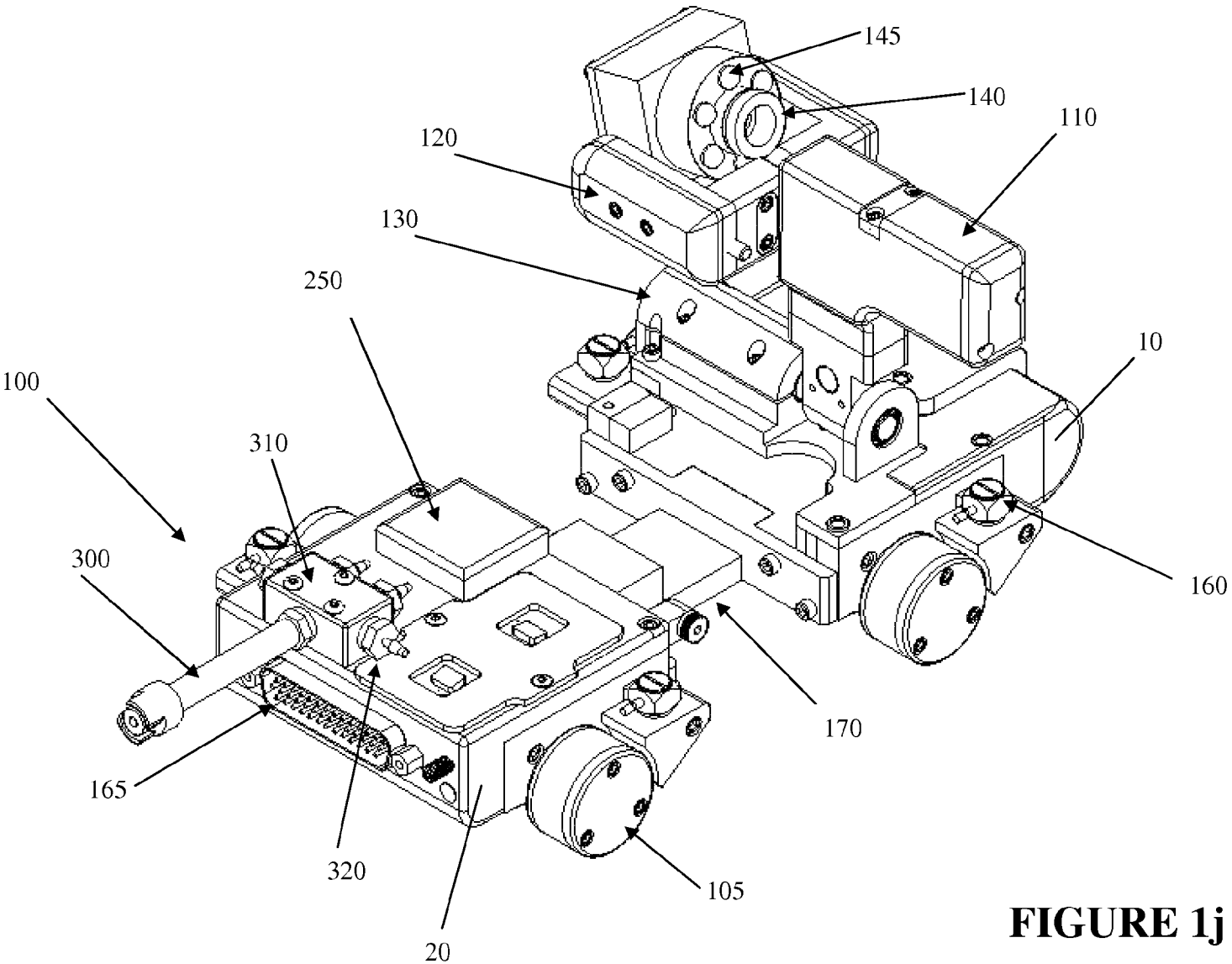
FIG. 1*j* shows a different perspective view of the embodiment of the present invention as depicted in FIG. 1*i*.
Figure 1K:
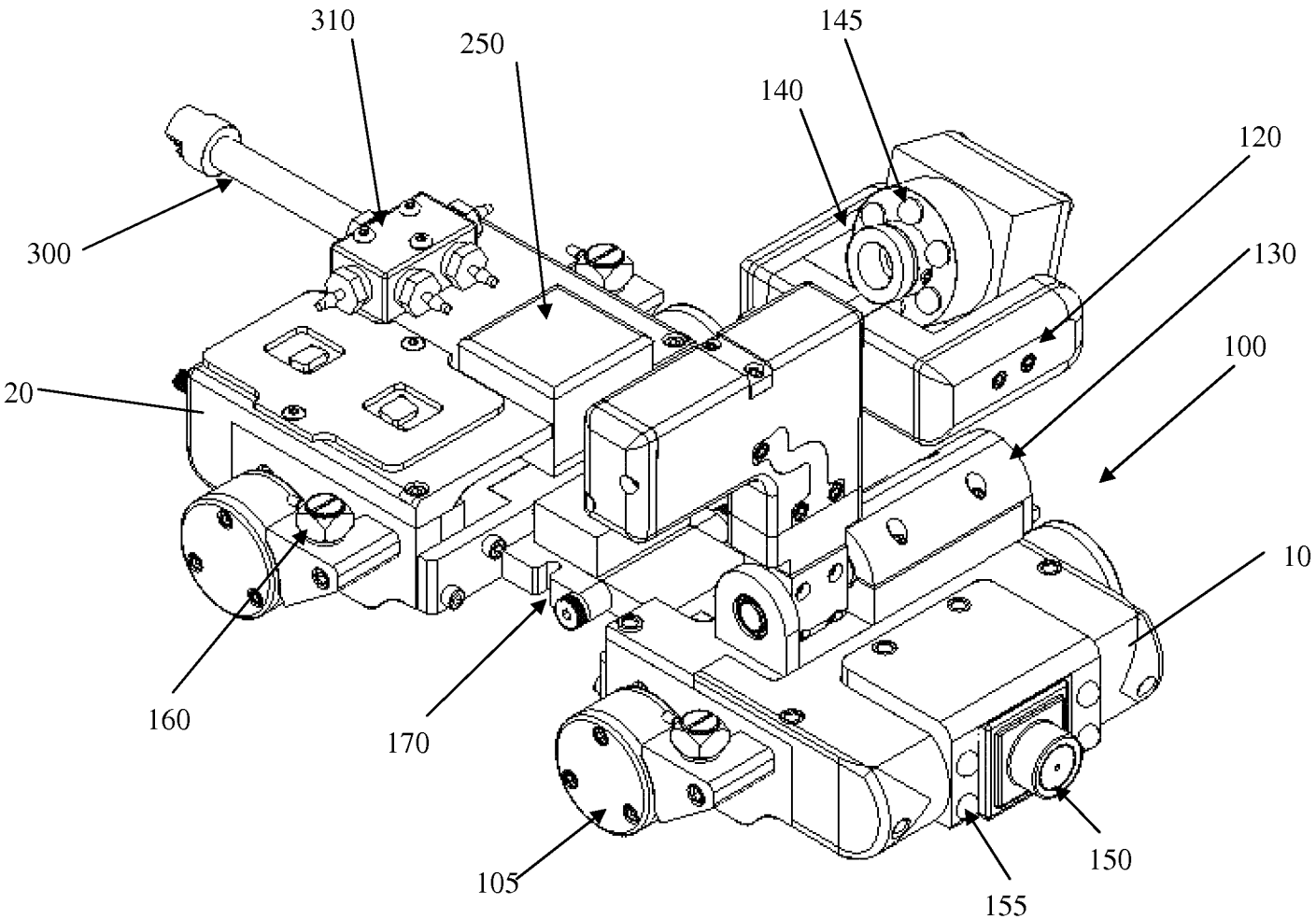
FIG. 1*k* shows yet another perspective view of the embodiment of the present invention as depicted in FIGS. 1*i*-1*j*.
Figure 11:
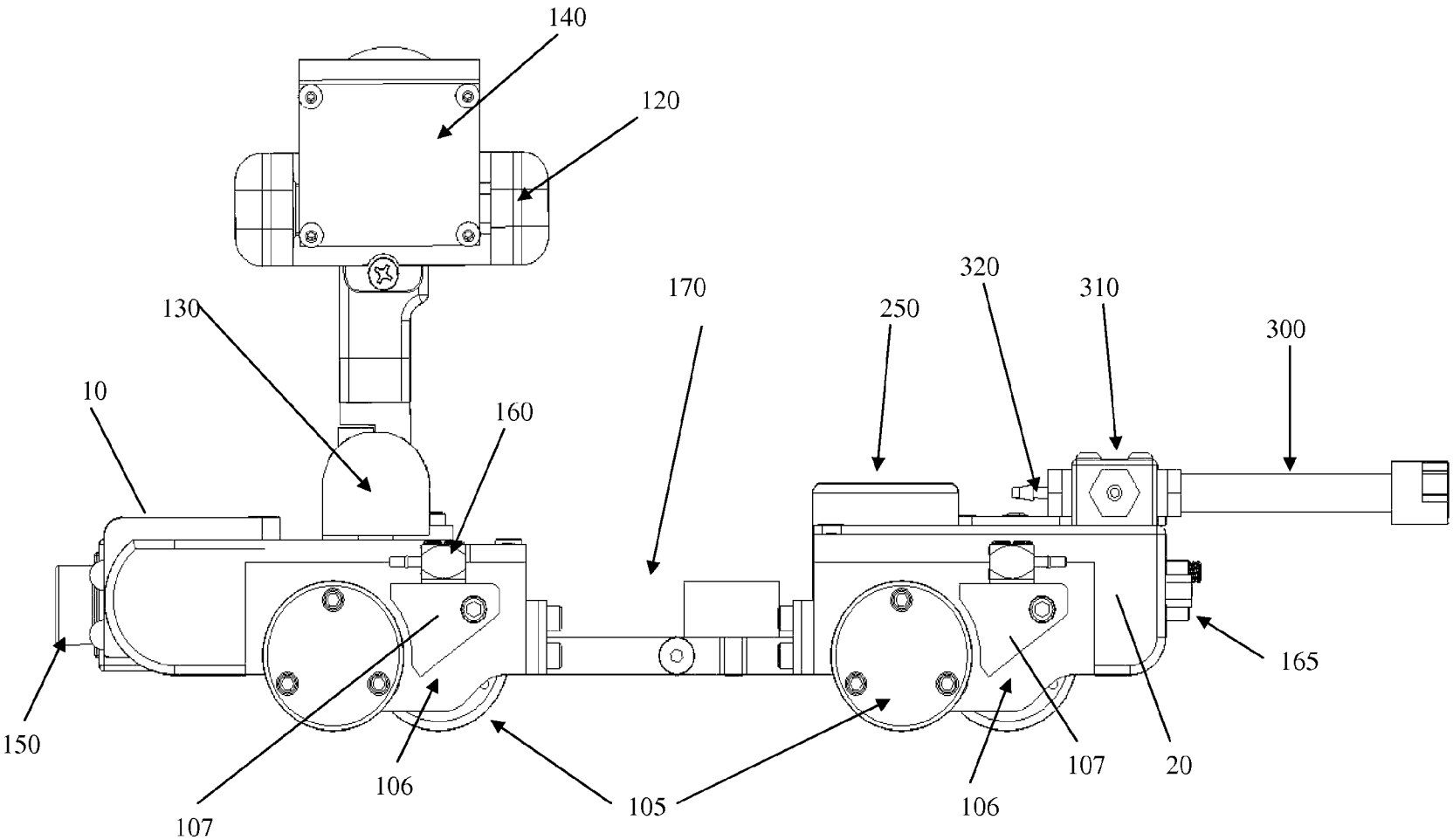
Figure 1M:
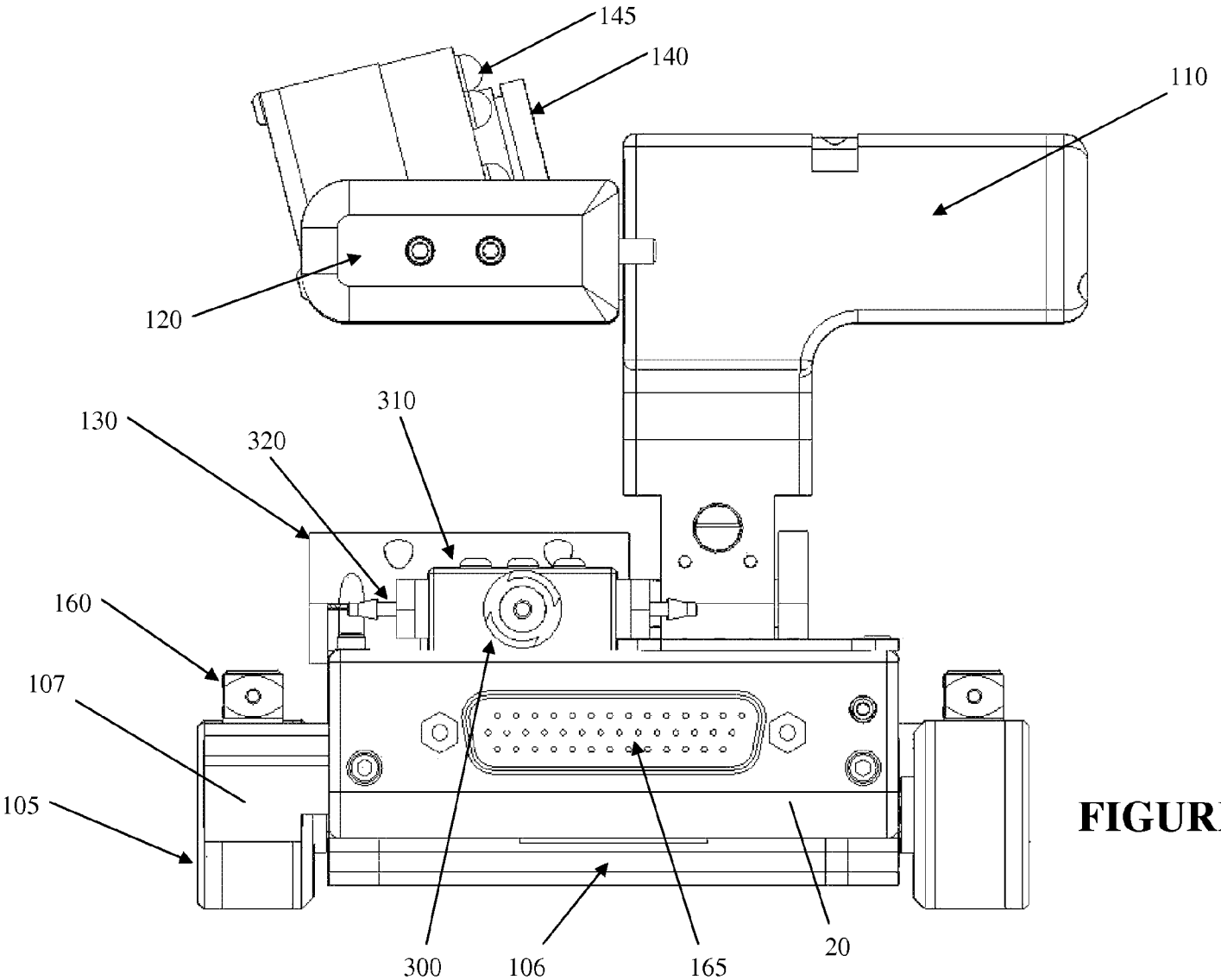
FIG. 1*m* shows a rear view of the embodiment of the present invention as depicted in FIGS. 1*i*-1*l*.
Figure 1N:
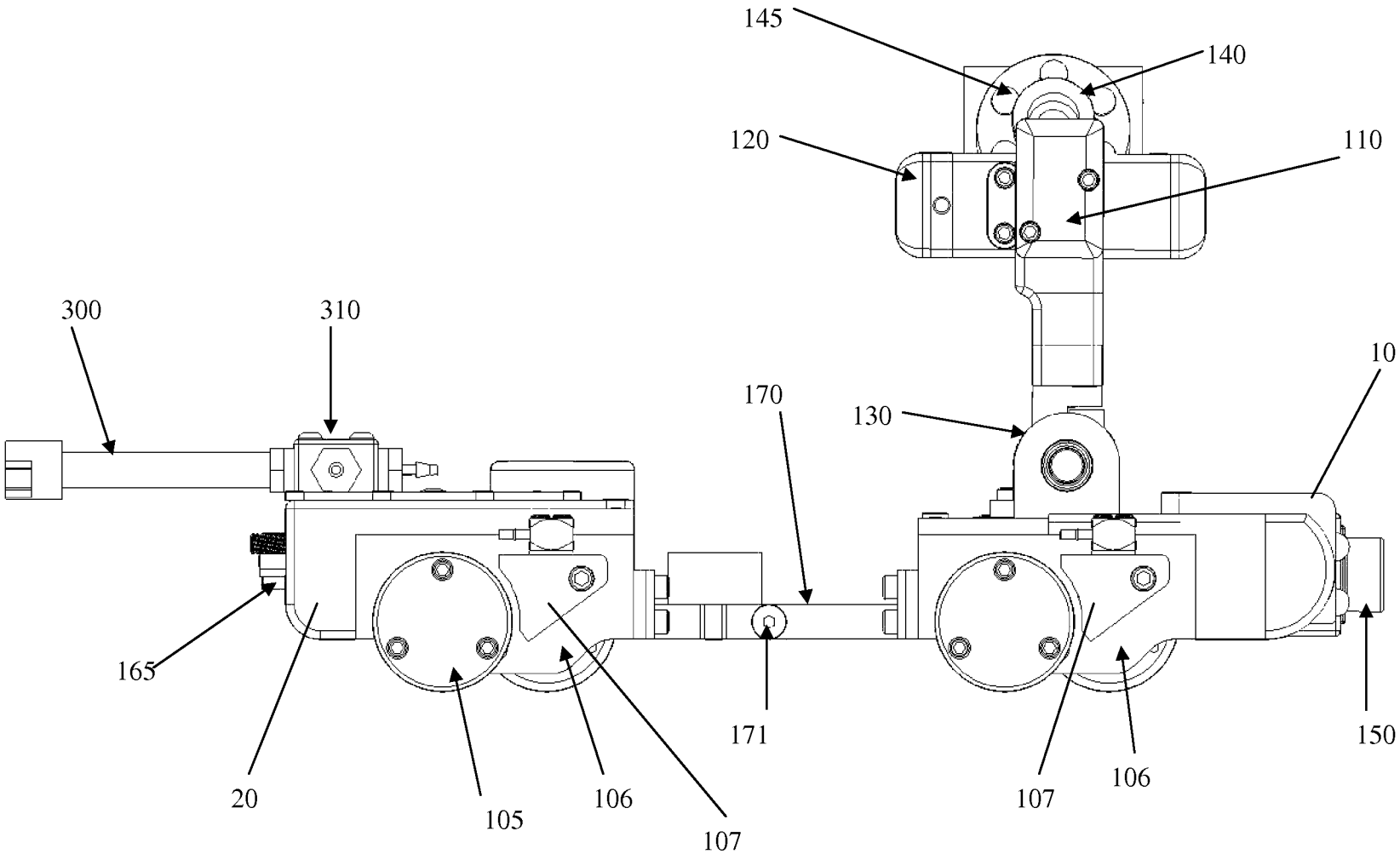
FIG. 1*n* shows a second side view of the embodiment of the present invention as depicted in FIGS. 1*i*-1*m*.
Figure 1O:
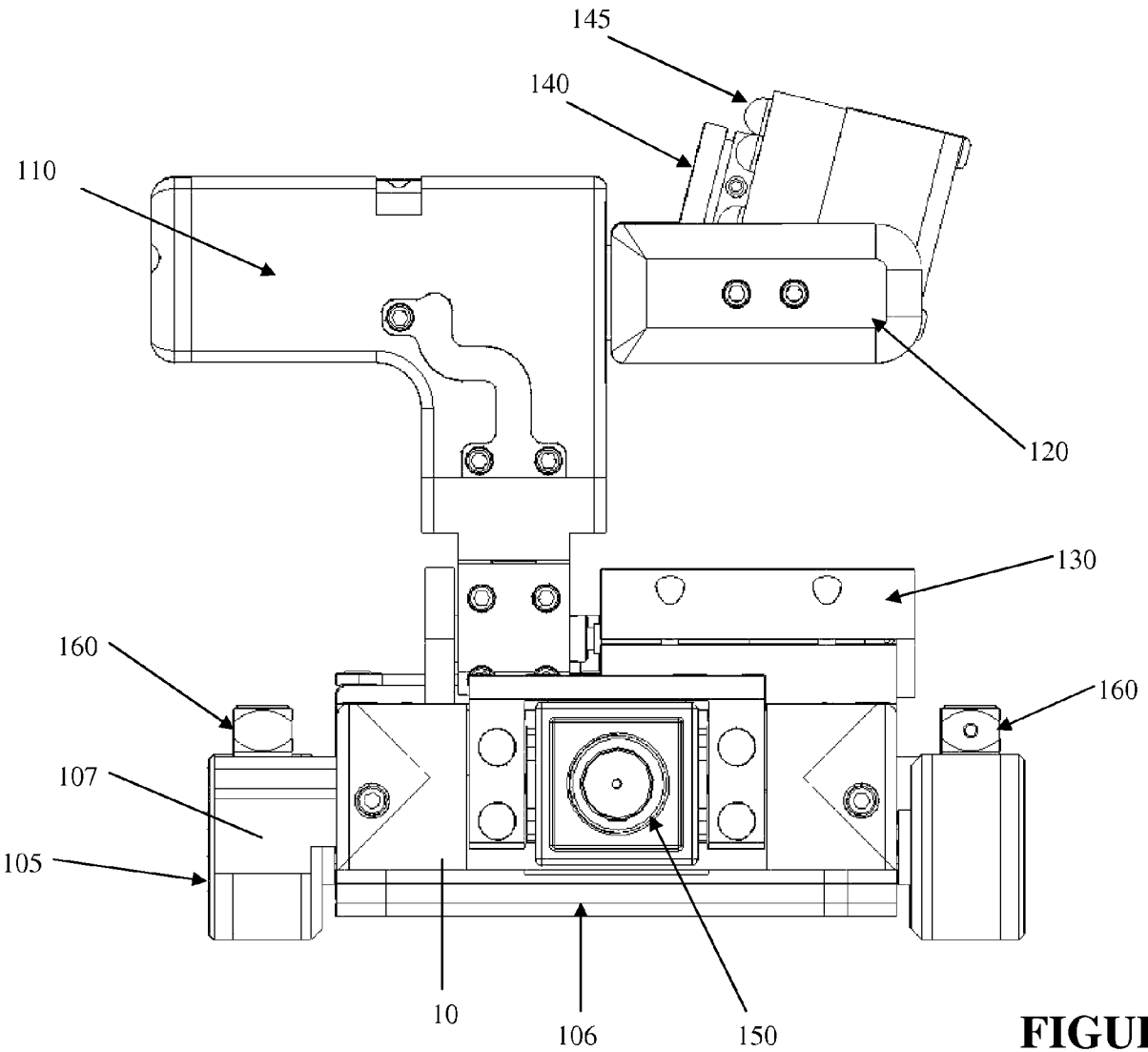
FIG. 1*o* shows a front view of the embodiment of the present invention as depicted in FIGS. 1*i*-1*n*.
Figure 1P:
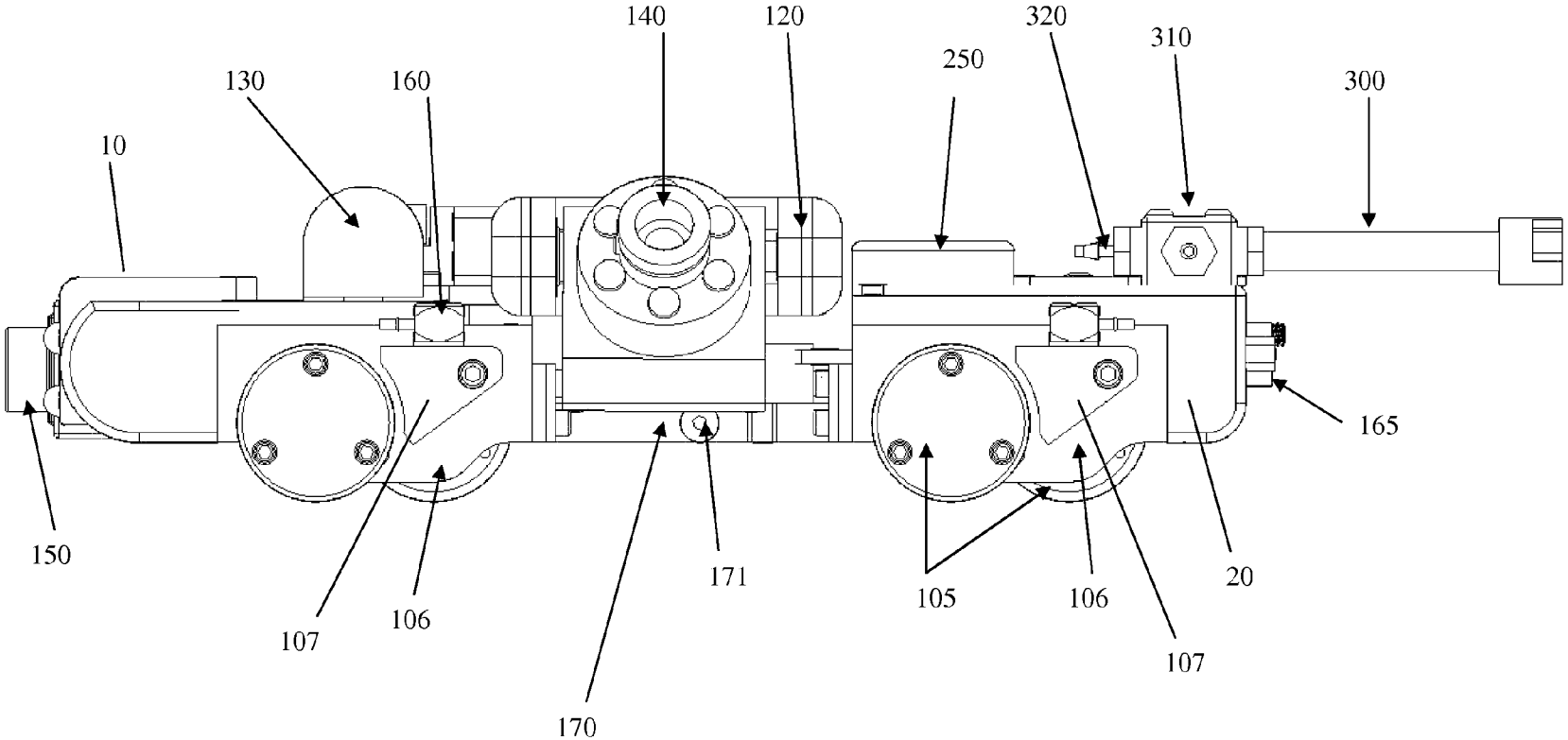
FIG. 1*p* shows a side view of the embodiment of the present invention as depicted in the preceding FIGS. 1*a*-1*m*, with the camera assembly in a stowed configuration.

The presently disclosed concepts relate, in at least some aspects, to an inspection system utilizing a magnetic inspection vehicle 100 and, more particularly, to a steam generator shell wrapper annulus inspection system comprising a magnetic inspection vehicle 100, such as is shown by way of example in FIGS. 1*a*-1*p*. The inspection system disclosed herein comprises a remote camera system deployed in combination with an inspection vehicle 100, such inspection system being configured to thereby perform visual inspections, such as to perform observation of the presence of free or solidified sludge and/or foreign material or objects in the annulus region of a steam generator, such visual inspections being represented by way of example in FIGS. 2*a*-2*b* and 3-4. This system is configured to examine 360° of the top of the tube sheet annulus and periphery tubes from the tube sheet level to the bottom edge of the Flow Distribution Baffle (FDB), particularly providing views of the high-flow regions in the secondary side of steam generators. This system is also configured to inspect at least three tubes into the tube bundle.

This inspection vehicle 100 comprises three main parts or systems, a delivery platform, a camera assembly, and an umbilical, as described further below.

The delivery platform comprises a front car 10 and a rear car 20 connected together by a connecting element (e.g., hinge 170) permitting relative motion between the front car 10 and the rear car 20 along at least one axis. Each of the front car 10 and rear car 20 comprise two wheels 105, in the depicted embodiment, each of the wheels 105 being separately driver by a motor 106. One example of a suitable motor is the MicroMo 1331T012S 14/1, manufactured by MicroMo Electronics, Inc. of Clearwater, Fla., USA. The wheel 105 motors 106 provide the magnetic wheels with power to drive around the annulus. The magnetic wheels 105, comprising samarium or neodymium magnets (e.g., $Nd_2Fe_{14}B$, $Sm_2Co_{17}$, etc.), are themselves configured to provide sufficient magnetic attraction to prevent the system from slipping down the steam generator shell during operation. The connecting element (e.g., hinge 170) allows the system to articulate on the curved inside diameter of the shell to ensure contact with it surface at all times.

In a presently preferred configuration, the wheels 105 are attached directly to end of the drive motor 106 and the wheels are disposed in an offset relationship to maintain the overall dimensional envelope of the inspection vehicle within typically encountered constraints imposed by steam generator handhole penetrations (e.g., it must fit through a 5.83" or 148 mm diameter opening). As depicted, the overall dimensions of the inspection vehicle 100 are 8.00" (L)×4.90" (W)×2.00" (H), excluding the connector 300, described below. The overall dimensional envelope of the camera assembly comprising the first arm 110, second arm 120, and inspection camera 140 is 4.90" (L)×3.35" (W)×1.33" (H). Wheels 105 are 1.00" in diameter. Other pressure vessels, pipes, or systems to be inspected may permit corresponding variations to the embodiment depicted herein where similar sizing constraints are not present.

The delivery platform also comprises auxiliary lights 155 disposed about the front of the rear car 10, four lights in the illustrated example, to provide lighting in the direction of movement of the inspection vehicle 100. In one aspect, the lights 155 comprise white LED lights such as, but not limited to, Nichia Corp. white LEDs, model no. NSPW500BS, or DRAGONtape® White 430 Lumen LEDS, Model No. OSRAM DT6-W4F-854.

The camera assembly comprises a first arm 110 bearing a pan motor, a second arm 120 bearing a tilt motor, an extend motor 130 (under the depicted housing) and camera 140, as shown generally in FIGS. 1*a*-1*p*. These arms and motors confer full pan and tilt capabilities to the attached inspection camera 140. In a presently preferred aspect, one or more of the tilt motor, pan motor, and extend motor are MicroMo DC-micromotor 0816008S+08/1 1024:1, manufactured by MicroMo Electronics, Inc. of Clearwater, Fla., USA.

An additional navigation camera 150 is optionally disposed at the front of the inspection vehicle 100 to provide a view in the direction of movement of the inspection vehicle 100 and thereby facilitate "driving" of the inspection vehicle by a remote operator located outside the steam generator (or other inspection environment). In a presently preferred aspect, the depicted inspection camera 140 is a STC-N64 or STC-P64 high-resolution, high performance CCD color board camera manufactured by Sensor Technologies America, Inc., of Carrollton, Tex., USA, configured to provide live video. The drive camera 150 may comprise the STC-N64, or may comprise another make and model of camera, such as the KT&C KPC-EX20P3 or KPC-S20CP3 camera. Further, in an alternative configuration to that depicted in the accompanying figures, the navigation camera 150 is omitted and the inspection camera 140 is itself utilized for both navigation and inspection functions.

Thus, as depicted, the inspection system is equipped with two camera assemblies, a forward facing color stationary camera 150 (and lighting 155) used for navigation and general observation and a top mounted Pan/Tilt color camera 140 (and lighting 145) used for inspection. The pan motor in first arm 110 allows the camera to pan left and right and the tilt motor in the second arm 120 allows the camera to look up and down. The extend motor 130 allows the first arm 110 to move in and out of the body of the inspection vehicle 100.

Figure 5:
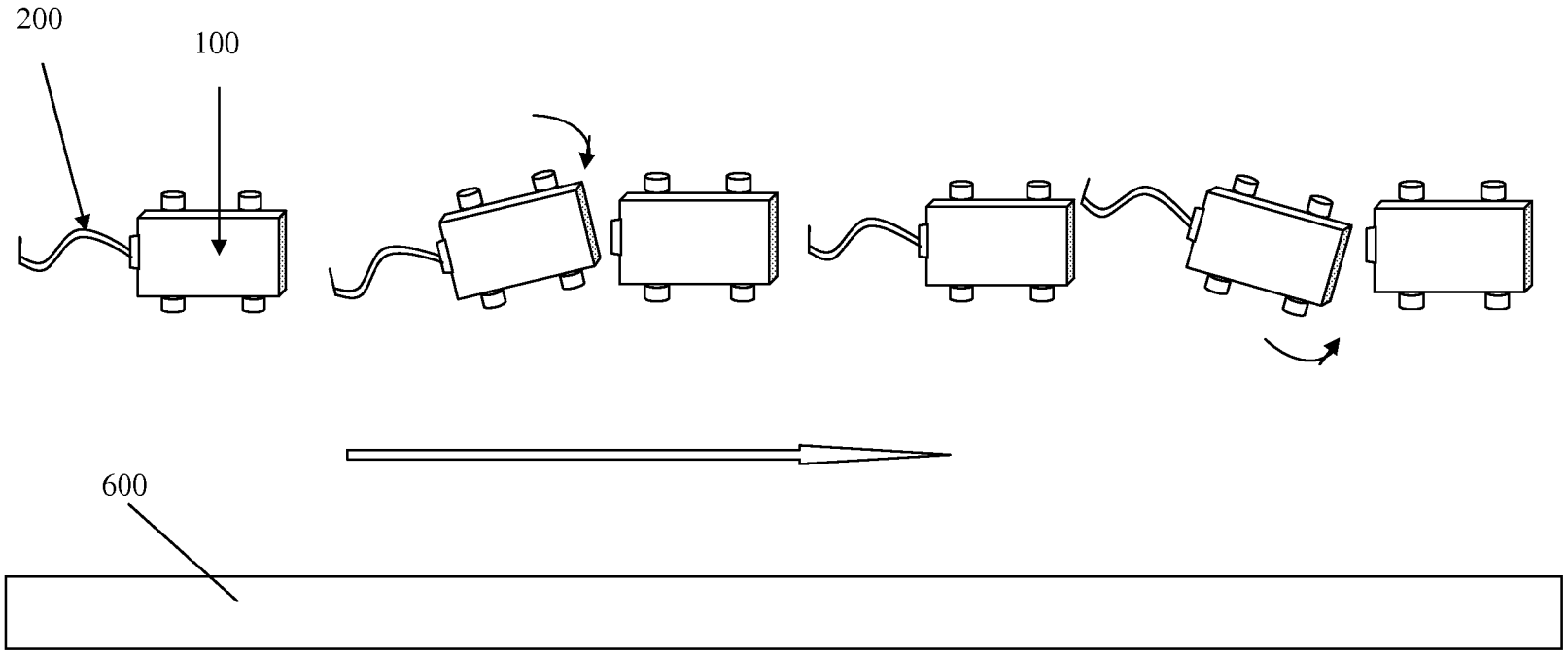
FIG. 5 illustrates operation of an orientation auto-correct system of an inspection vehicle in accord with at least some aspects of the present concepts.

The umbilical generally refers to the connection between the inspection vehicle 100 and the operator of the inspection vehicle and includes the connector port 165, pneumatic connector 300, pneumatic manifold 310, and cable 200 (FIG. 5).

In at least some aspects of the present concepts, a first umbilical cord provides power to the inspection vehicle 100, enabling transmission of signals (e.g., video signals, control signals, etc.) between the inspection vehicle 100 and the operator, and a second umbilical cord providing compressed gas (e.g., air) to a pneumatic delivery system comprising the pneumatic connector 300 and pneumatic manifold 310. In at least some aspects, the umbilical length is about 50 feet, but the umbilical length may longer (e.g., 100', 150') or shorter to suit the particular application.

The pneumatic delivery system also comprises flexible pneumatic tubes (not shown) are disposed to connect the outlet nozzles of the pneumatic manifold 310 to corresponding inlet nozzles of the air hubs or pneumatic fittings 160, which are attached to a top portion of each wheel block 107. The compressed gas (e.g., air) is then ported through a hole in the top of the wheel block 107, through one or more passages, to one or more openings (e.g., 3 small holes or convergent nozzles)(not shown) formed in an inner radius of the wheel block. In other words, the opening(s) are generally adjacent the surface of the wheel and are configured to direct compressed gas to the respective wheel 105 to remove particles (e.g., magnetite) or debris adhering to the magnetic wheels. In various aspects, the supply of compressed gas may be controlled locally by the operator and may be either left open, so as to continuously supply compressed gas (e.g., air) to the inspection vehicle, or selectively isolated when not needed. Alternatively, the pneumatic manifold 310 may comprise valves that may be selectively (or automatically) cycled to discharge air the one or more openings formed in an inner radius of the wheel block to impinge upon the respective wheel or to divert air from one or more of the wheels to one or more of the other wheels.

In an alternative configurations, the compressed air system may be utilized in combination with scraping members (not shown) formed of Delrin or stainless steel, for example, and disposed proximal to each wheel 105, or may be omitted in favor thereof.

Turning to the series of images depicted in FIGS. 1*a*-1*p*, FIG. 1*a* shows an example wherein the camera 140, first arm 110, and second arm 120 are stowed in a correspondingly-shaped (e.g., substantially mating) space or receiving area formed between the front car 10 of the inspection vehicle, the rear car 20 of the inspection vehicle, and the connecting member (e.g., hinge 170) connecting the front car to the rear car. In this stowed configuration, the top surfaces of the camera 140, first arm 110, and second arm 120 are dimensioned to be lower than or equal in height to the upper surface of the extend motor 130 housing and other components, as is shown in FIG. 1*p*, thus limiting the height of the inspection vehicle 100. Laterally, the distal or outward surfaces of the inspection camera 140 are also inboard of the outer surfaces of the wheels 105.

FIG. 1*b* shows the first arm 110 in a first inclined position (e.g., 30°, as shown) from its initial stowed position. The first arm is directly attached to the shaft of the extend motor 130 so the rotation of the motor shaft causes a corresponding rotation of the first arm. FIG. 1*c* shows the first arm 110 in a second inclined position (e.g., 90°, as shown) from its initial stowed position. FIG. 1*d* likewise shows, subsequent to the configuration depicted in FIG. 1*c*, movement of the second arm 110 to a first inclined position (e.g., 30°, as shown) from its initial stowed position in FIGS. 1*a*-1*c*. FIG. 1*e* shows the second arm 120 moved to a second inclined position (e.g., 90°, as shown) from its initial stowed position. As with the first arm 110, the second arm 120 is directly attached to the shaft of the pan motor disposed in the first arm 110 so that the rotation of the pan motor shaft causes a corresponding rotation of the second arm 120.

FIG. 1*f* shows, subsequent to the configuration depicted in FIG. 1*e*, movement of the inspection camera 140 to a first inclined position (e.g., 30°, as shown) from its initial stowed position in FIGS. 1*a*-1*e*. FIG. 1*g* shows the inspection camera 140 moved to a second inclined position (e.g., 90°, as shown) from its initial stowed position. FIG. 1*h* shows the inspection camera 140 moved to a third inclined position (e.g., 120°, as shown) from its initial stowed position. FIG. 1*i* shows the inspection camera 140 moved to a fourth inclined position (e.g., about 175°, as shown) from its initial stowed position. In one configuration, the inspection camera 140 is directly attached to the shaft of the tilt motor disposed in the second arm 120 so that the rotation of the tilt motor shaft causes a corresponding rotation of the inspection camera 140. In an alternative configuration, the axis of rotation of the inspection camera may be driven by a pulley and belt configuration housed within the second arm 120, with the pulley in turn being driven by a pinion attached to the shaft of the tilt motor. Rotation of the inspection camera 140 could also be effected utilizing a compression wheel or any other motive force.

FIGS. 1*j*-1*k* show isometric views of the inspection vehicle 100 in the same configuration depicted in FIG. 1*i*, with FIG. 1*j* showing a predominantly rear view and FIG. 1*k* showing a predominantly front view. FIGS. 1*l*-1*o* likewise show a first side view, a rear view, a second side view, and a front view of the configuration depicted in FIG. 1*i*.

FIG. 1*p* shows a side view of the inspection vehicle 100 depicted in FIG. 1*a*, with the inspection camera 140 in a stowed configuration.

In a steam generator inspection application, such as is depicted in FIGS. 2*a*-2*b* and 3-4, the inspection camera 140 is configured to inspect the entire annulus of a steam generator 500, including a 360° field of view, around the circumference of the steam generator, from the top of the steam generator tube sheet annulus (i.e., in the downcomer region between the steam generator 500 and the steam generator cylindrical wrapper 510) down to the tubesheet level, viewing the peripheral tubes and some interior tubes from the bottom edge of the steam generator flow distribution baffle to the tubesheet. It is to be noted that, for simplicity and clarity, the umbilical connection between the inspection vehicle 100 and the operator inspection vehicle 100 are not shown in FIGS. 2*a*-2*b* and 3-4.

Figure 2A:
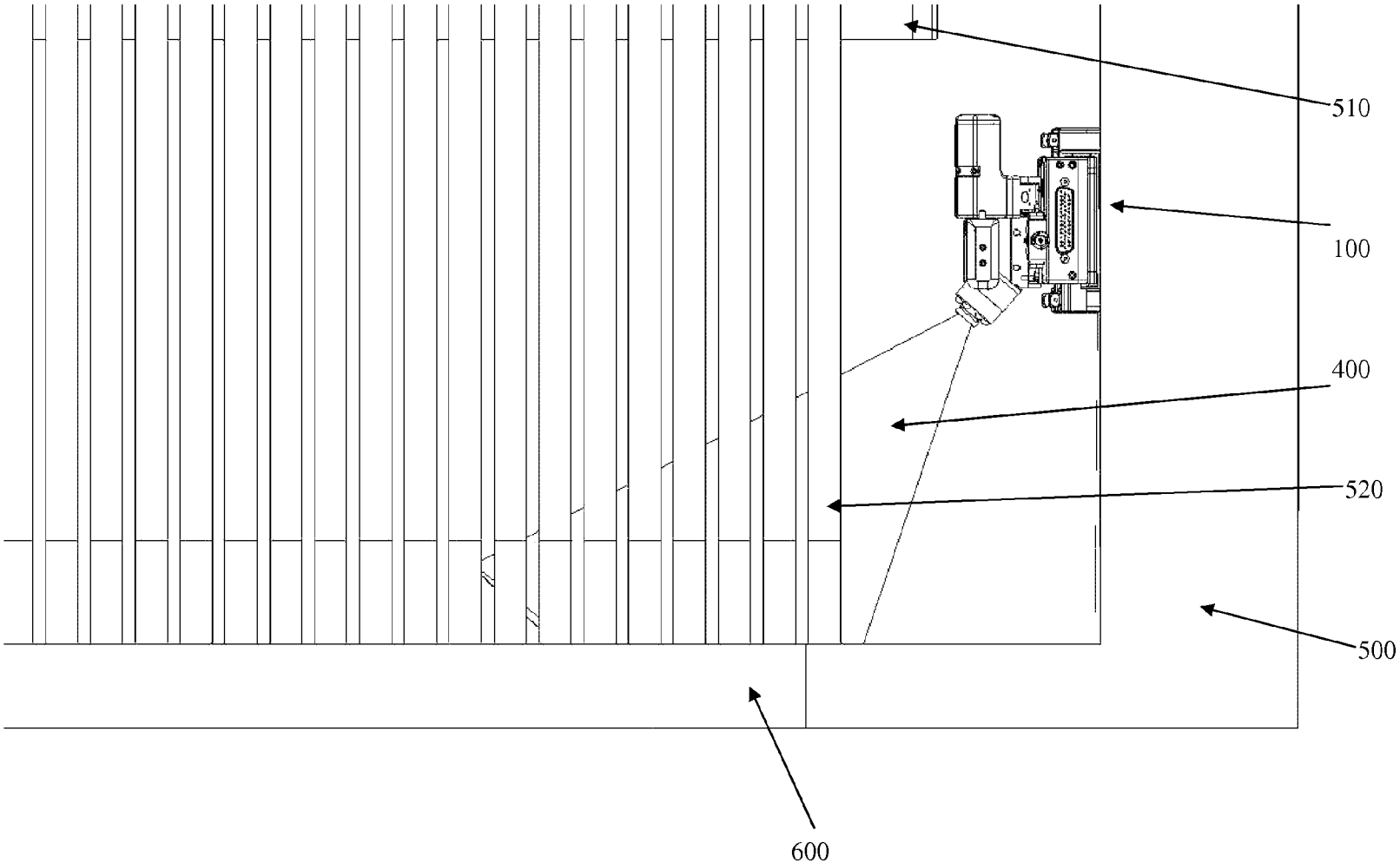
FIG. 2*a* depicts an inspection vehicle in accord with at least some aspects of the present concepts disposed in a steam generator, with an inspection camera aimed downwardly toward the tubesheet.
Figure 2B:
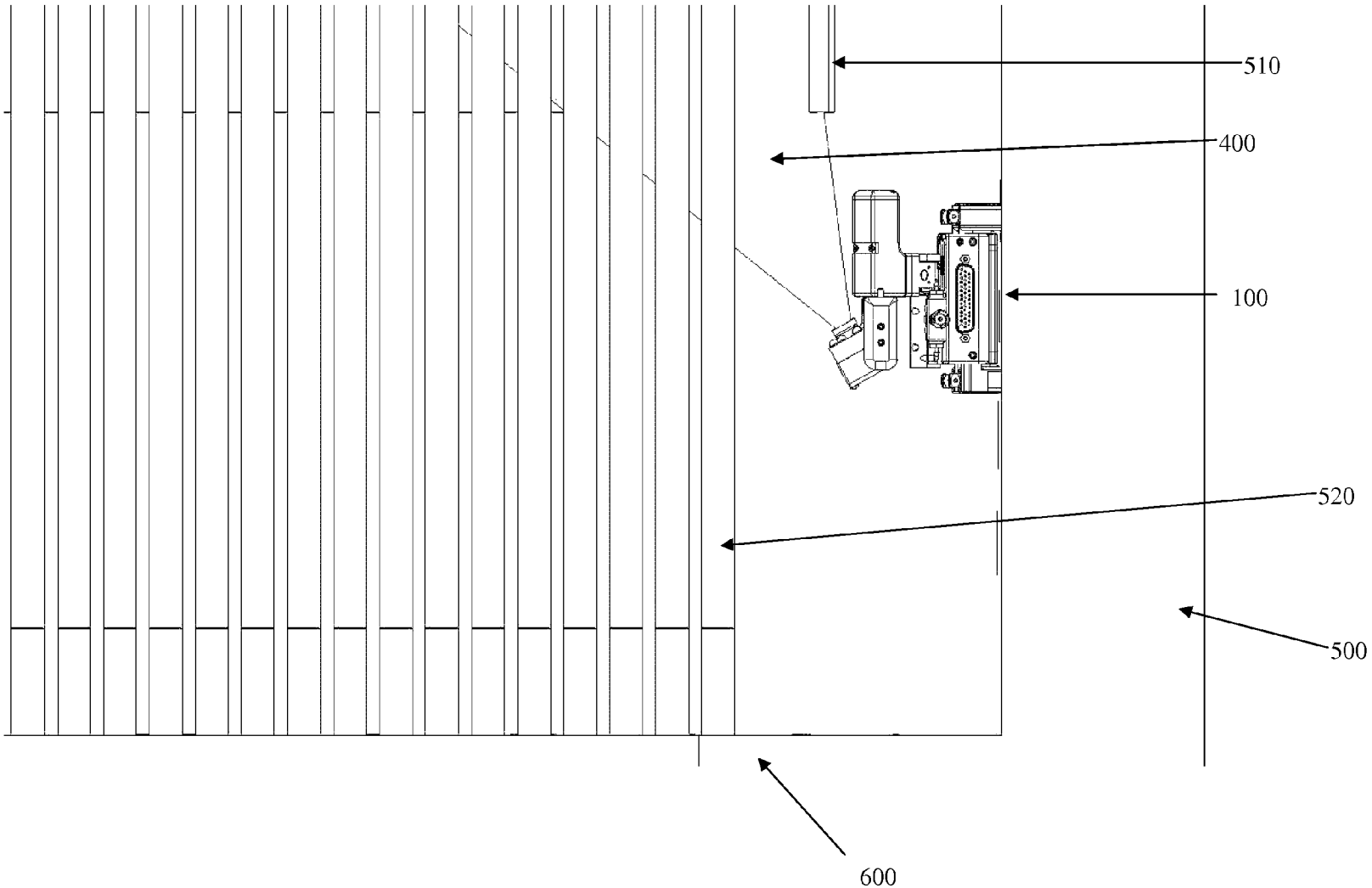
FIG. 2*b* depicts an inspection vehicle in accord with at least some aspects of the present concepts disposed in a steam generator, with an inspection camera aimed upwardly toward the flow distribution baffle (FDB)/wrapper interface.
Figure 3:
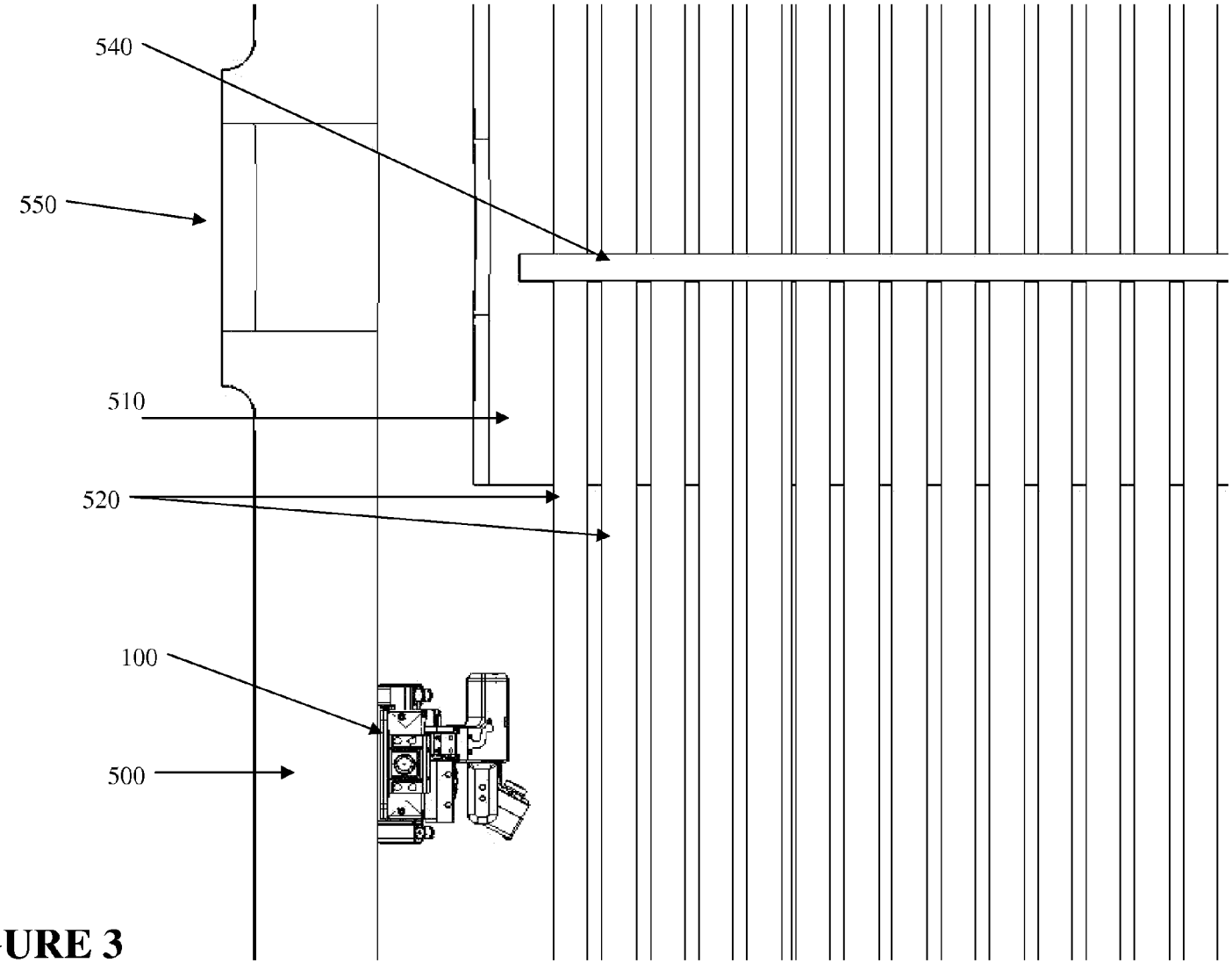
FIG. 3 shows another view of an inspection vehicle in accord with at least some aspects of the present concepts disposed in a steam generator, with an inspection camera aimed upwardly toward the flow distribution baffle (FDB)/wrapper interface.
Figure 4:
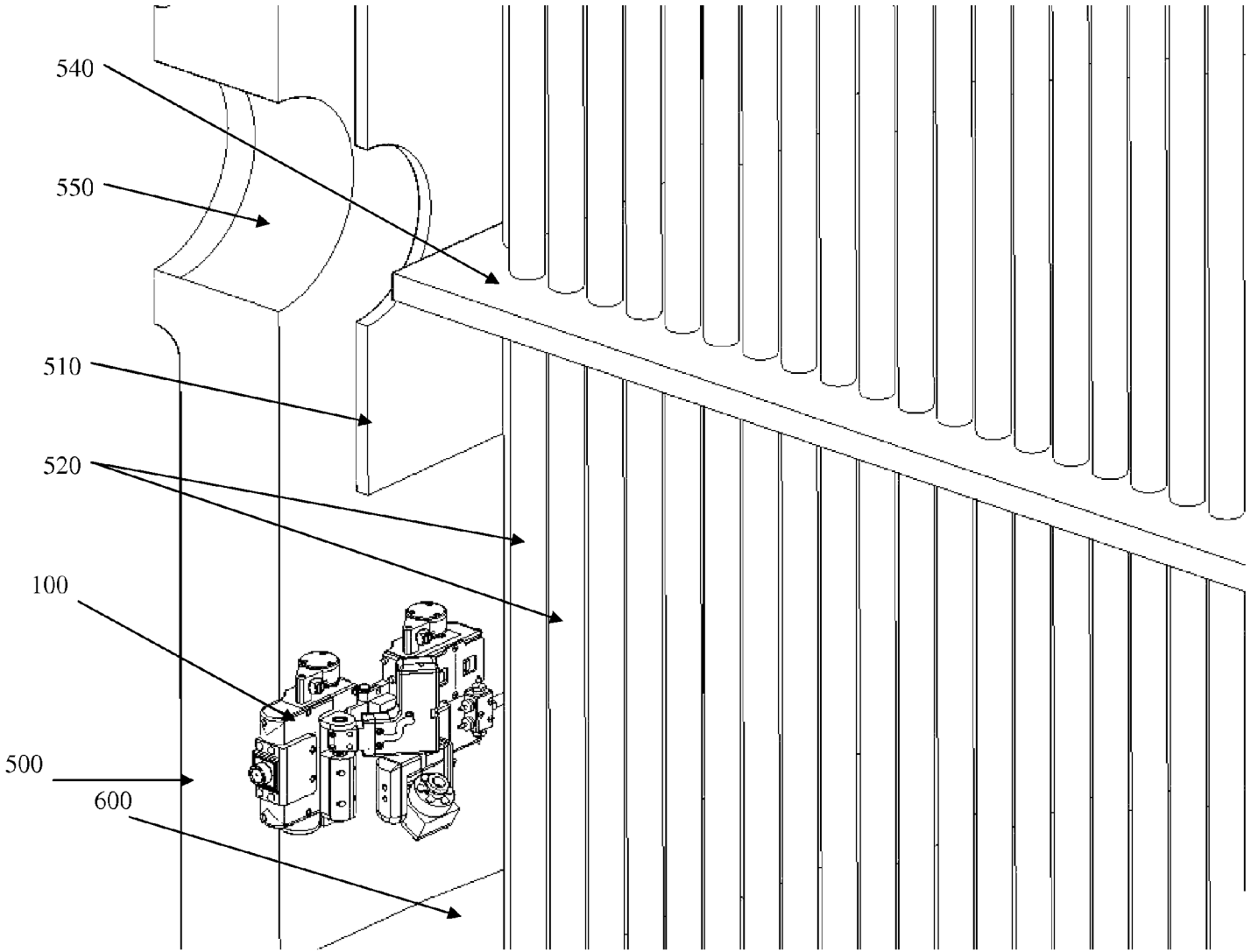
FIG. 4 shows an isometric view of the inspection vehicle shown in FIG. 3.

As shown in the viewing cone 400 in FIGS. 2*a*-2*b*, the inspection camera 140 is configured to provide to the operator video images of a minimum of three tube 520 columns in-bundle from the tubesheet 600 (e.g., approximately seven tube columns are shown to be contained within the viewing cone 400 in FIG. 2*a*) up to the bottom of the flow distribution baffle (FDB)/support plate interface.

In the steam generator inspection application depicted in FIGS. 2*a*-2*b* and 3-4, the inspection vehicle 100 may thus be used, for example, to perform visual inspections to search for and locate any foreign objects that may be present in the steam generator annulus area, tubesheet, or generally peripheral U-tubes and/or to inspect for general cleanliness. Moreover, the inspection vehicle 100 and associated system permits detailed inspection of the annulus and high flow regions while minimizing personnel radiation exposure.

The inspection vehicle 100 also optionally, but advantageously, comprises a tilt sensor 250, depicted in FIGS. 1*a*-1*p*. The tilt sensor 250 outputs signals that are utilized, either on-board or using a remote processing device, to provide an auto-correct (e.g., auto-leveling) signal to the vehicle's wheels 105 to drive the wheels 105 in a manner to position the vehicle parallel to or generally parallel to the tubesheet or any other reference. The tilt sensor 250 and associated auto-correct feature are adapted, in part, to drive individual wheels 105 of the inspection vehicle 100 so as to align the inspection vehicle 100 to a desired orientation, which could be any pre-selected orientation. Although in some aspects, the desired orientation would be horizontal or substantially horizontal, so as to be parallel to or substantially parallel to the tubesheet in a steam generator inspection, other orientations may be selected. Thus, the inspection vehicle 100 auto-correct feature may be configured to align the inspection vehicle 100 to an orientation selected by a user.

As shown in FIG. 5, the inspection vehicle 100 is shown to auto-correct its position as it moves in the direction of the arrow so that the inspection vehicle 100 maintains an orientation that is parallel to the tubesheet 600. However, forward motion of the inspection vehicle 100 is not required for the auto-leveling to take place and the auto-leveling feature is also active when the inspection vehicle 100 is stationary. For example, auto-leveling may be accomplished by selection rotation of each of the wheels 105 or selected wheels. Additionally, the tilt sensor 250 may optionally be integrated into other parts of the vehicle, umbilical connector port 165, a cord/tube/cable 200 connected to the inspection vehicle 100 or pneumatic connector 300, or the pneumatic connector 300, so long as it faithfully indicates an orientation of the inspection vehicle 100.

In at least one aspect of the present concepts, the auto-correct feature is based on a feedback signal provided from the tilt sensor 250. An analog close loop circuit is formed between the inspection vehicle 100 and an open loop control box (not shown) operated by the operator of the inspection vehicle. The open loop control box comprises an open loop control system (OLCS) or manual control system that is preferably used to operate the vehicle and includes controls (e.g., a knob) to permit adjustment with a desired fineness of the desired orientation of the tilt sensor. Any number of predetermined orientations may be provided as selectable options for the operator. By way of example, two predetermined orientations may be provided at 180° apart, such predetermined orientations being enabled by a select switch, to allow the operator to, for example, deploy the inspection vehicle 100 from the same access port to inspect the hot leg or cold leg side of the annulus.

Figure 6:
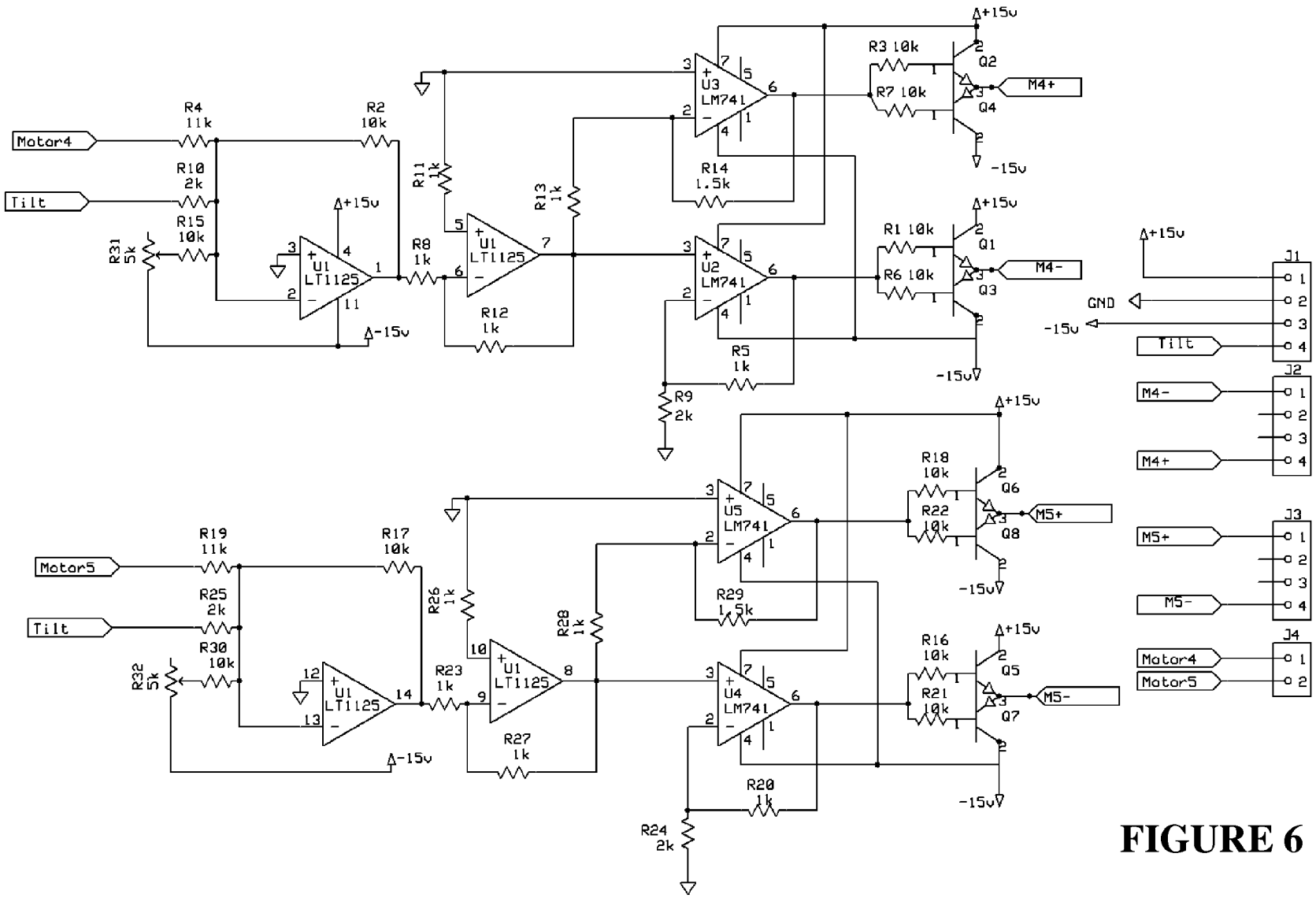
FIG. 6 illustrates an example of an orientation auto-correct circuit in accord with at least some aspects of the present concepts.

FIG. 6 shows one example of a circuit that may be utilized to provide the auto-correct features noted above. The correcting or leveling feedback signal is used to bias a differential stage (Operational Amplifier summing stage) of the analog close loop circuit. The signal is then proportionally (% of +/−Vmax) amplified through a DC operational amplifier driving stage which provides power to the drive motors.

Figure 7:
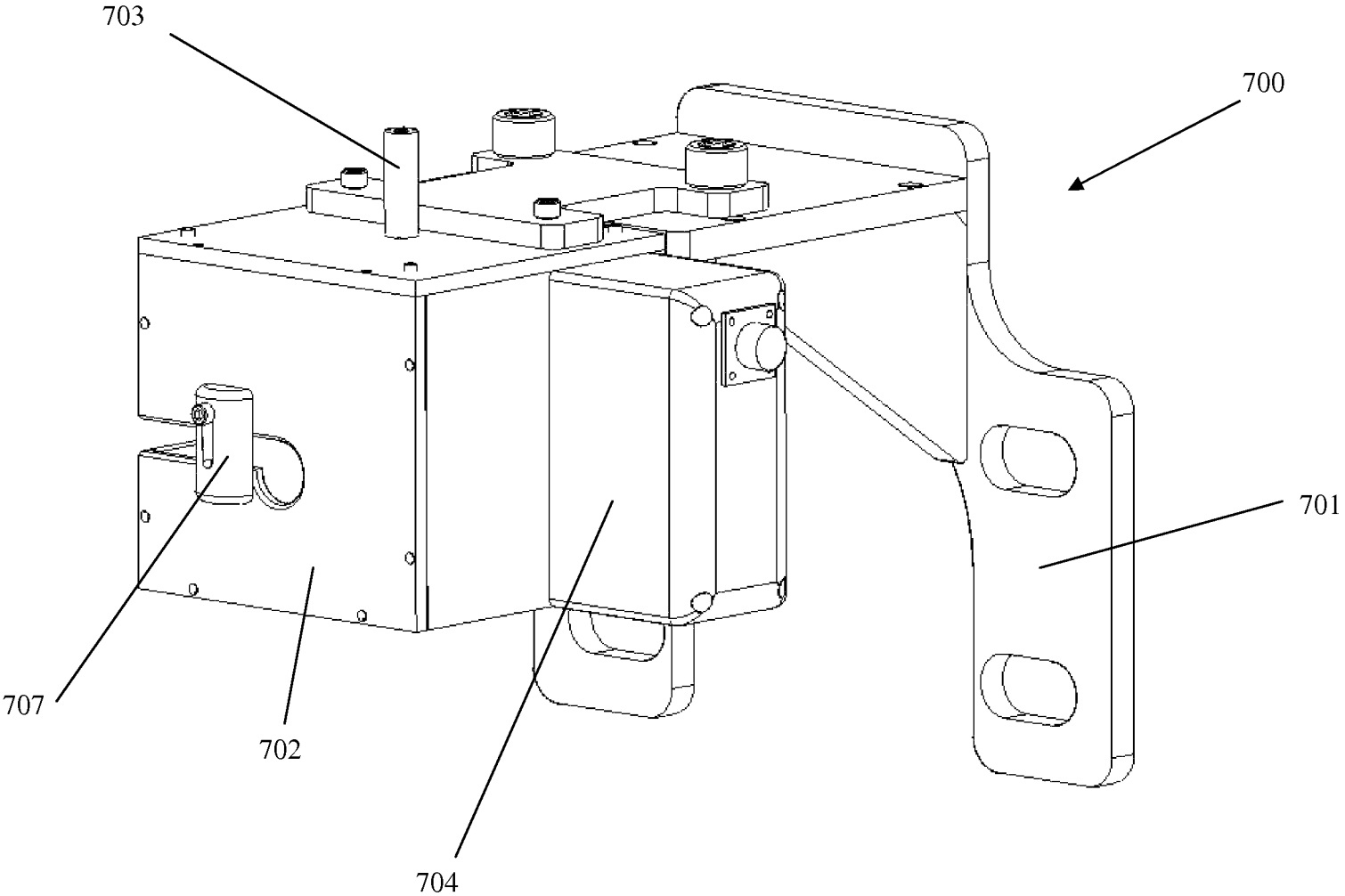
FIG. 7 illustrates an example of a cable management device in accord with at least some aspects of the present concepts.
Figure 8:
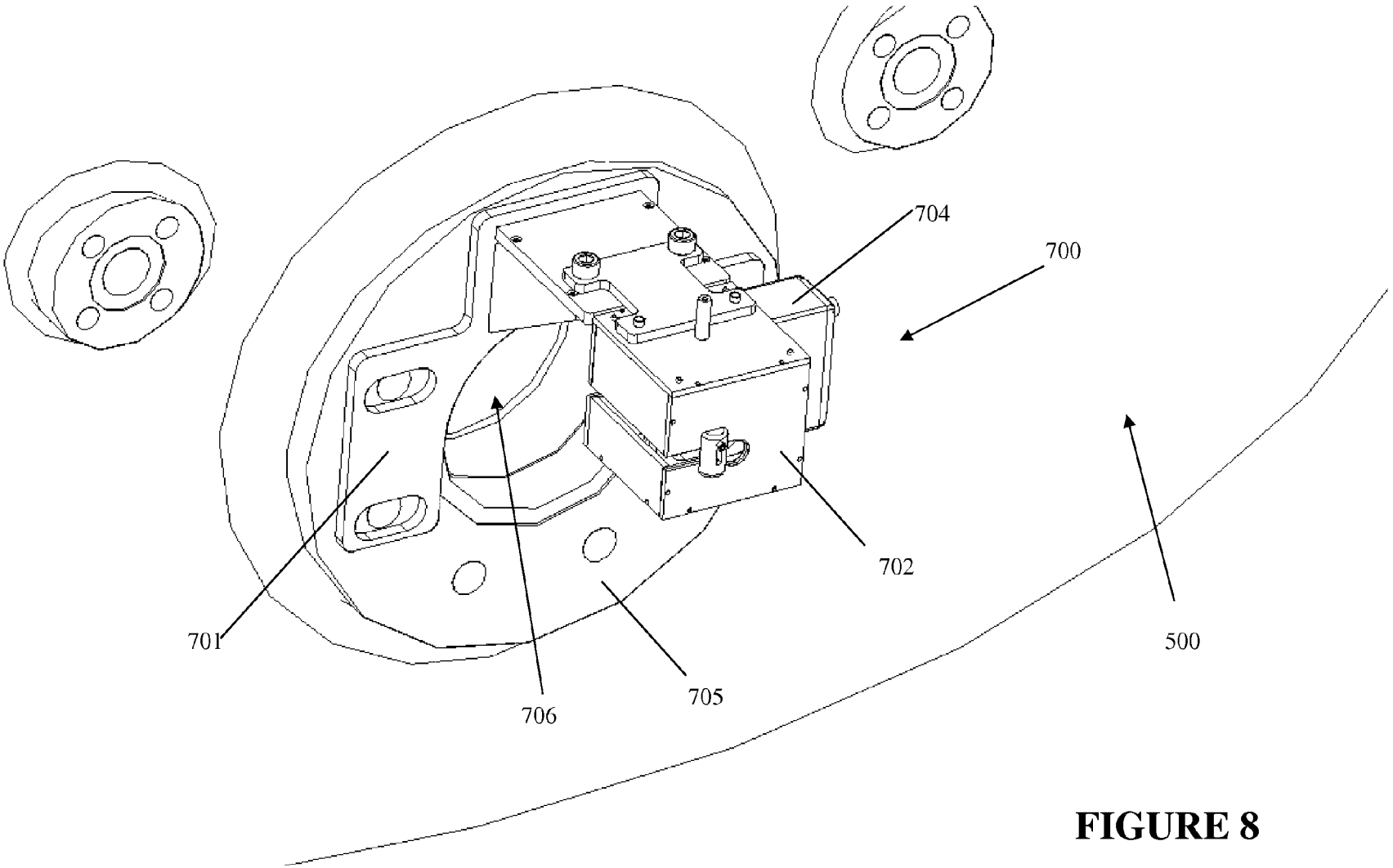
FIG. 8 illustrates an example of a cable management device mounted on a steam generator handhole flange in accord with at least some aspects of the present concepts.

A cable management system 700 is advantageously provided to feed and control the cables and tubes linking the inspection vehicle 100 to external systems (e.g., computer used by operator, open loop control box, etc.), and is represented by way of example in FIGS. 7-8. The cable management system 700 comprises, in the illustrated example, a mount flange 701 to permit the cable management system to be mounted to the steam generator handhole 550 (see FIG. 4). The particular configuration of the mount flange 701 is advantageously, but not necessarily, configured to be adaptable to different steam generator configurations. For example, the mount flange may comprise removable plates such that selected plates can be removed and replaced with different interchangeable plates adapted for use with a particular steam generator handhole configuration.

The cable management system 700 also comprises a roller housing 702 that houses the rollers and motors that grip or "pinch" the cable (e.g., 200) and drive it into or out of the steam generator responsive to or synchronously with control signals provided by the operator to the inspection vehicle 100. The electric drive motors, such as MicroMo 2842S012S+30/1 246:1 motors, each have rollers attached to them that pinch and push the cable in or out of the handhole.

The cable management system 700 also comprises a tension adjuster 703 comprising a shaft that can be pulled to facilitate cable installation. The tension adjuster 703 also comprises a spring to maintain tension on the cable(s). An electrical interface box 704 comprises the electrical connection point or interface between the internal electric dc servo motors of the cable management system 700 and the control module, the open loop control system (OLCS). With reference to FIG. 8, also shown are the steam generator handhole flange 705 and the steam generator handhole flange 706 in relation to the installed cable management system 700. Once the cable management system 700 is installed to the steam generator handhole flange 705, the cable latch keeps the cable (e.g., 200) inside the roller housing.

Prior to operation, a system check is desirably performed to verify that the inspection vehicle 100 and cameras are functioning, such as by checking the motor controls under speed settings expected to be used (e.g., high, low) to test forward, reverse, left and, right driving directions and verify correct motor response. It is also advantageous to test the inspection vehicle 100 cameras, such as by verifying the arm extend motor extends in both directions, verifying the inspection camera 140 tilts in both directions, and verifying the inspection camera 140 pans in both directions. The tilt sensor 250 may also be checked prior to operation by holding the vehicle in the air horizontally and, with the tilt sensor 250 on, by moving the front of the car down and the back of the car up. The vehicle will correct itself if the vehicle is not horizontal.

To set up the inspection system, the cable management mounting plate is installed to the handhole. Then, the inspection vehicle 100 is inserted into the steam generator and the cable (e.g., 200 in FIG. 5) is threaded through the cable entry of the umbilical/cable guide, which is then installed on the handhole. A motorized cable feeder is then mounted to handhole mount and cable inserted through a cable slot by pulling up on spring loaded plate. When the cable is properly positioned between feed wheels, the spring plate is released and both the front and back umbilical latch positioned and locked in place. The cable container is positioned directly behind the cable management system and cable ("umbilical") coiled inside so to minimize any tangling.

Once the inspection begins, the inspection vehicle 100 is moved in a desired direction (e.g., to the right) with the inspection camera 140 facing down the first row of U-tubes 520 toward the tubesheet 600 and the tilt sensor 250 turned on to level the inspection vehicle 100. The inspection camera 140 may then be panned up slowly looking into the tube bundle all the way up to the flow distribution baffle, as is shown in FIG. 2*b*. The inspection vehicle 100 is then moved forward one row and then the camera is panned back down to the tubesheet 600 looking into the tube bundle. This process is repeated around half of the steam generator. When the operator has completed inspecting one half of the tube bundle, the inspection vehicle 100 is put in reverse and driven back to the handhole, preferably while viewing the annulus region with the inspection camera 140. Once back to the original handhole, the inspection vehicle 100 can then be repositioned to inspect the other half of the steam generator through the same handhole, or the inspection vehicle 100 may be removed and installed at the opposite handhole, as desired, and the above steps repeated.

In operation, the inspection system is able to provide a live video feed to a remotely operated location. The inspection system, while being maneuvered inside the steam generator, is thus able to provide, for example, both a video feed of the view of the driving direction (via navigation camera 150) to the operating station and, as noted above, is capable of providing to such operator a video feed (via inspection camera 140) of the U-tubes in the tube bundle from the tube sheet, through the tube columns in-bundle, and to the bottom of the flow distribution baffle (FDB)/wrapper interface, as the inspection camera 140 pans from the tubesheet to the bottom of the FDB/wrapper interface.

Each of these embodiments and obvious variations thereof is contemplated as falling within the spirit and scope of the claimed invention, which is set forth in the following claims. For example, in at least one aspect of the present concepts, the second arm 120 may be fixed to the first arm 110, or omitted entirely, with the inspection camera 140 being respectively attached to either the first arm or the second arm and being configured accordingly only to pan, as opposed to pan and tilt.

What is claimed is:

1. An inspection vehicle, the inspection vehicle comprising:

a front chassis comprising two independently driven magnetic wheels;

a rear chassis comprising two independently driven magnetic wheels;

a connecting member flexibly connecting the front chassis to the rear chassis to permit relative motion between the front chassis and the rear chassis along at least one axis, the connecting member, front chassis, and rear chassis collectively defining a receiving area;

a navigation camera disposed on the front chassis; and a pan and tilt inspection camera assembly comprising a first rotatable arm driven by a first motor, a second rotatable arm disposed on a distal portion of the first rotatable arm, the second rotatable arm being driven by a second motor, and an inspection camera rotatably disposed on a distal portion of the second arm, the inspection camera being driven by a third motor, the camera assembly being dimensioned to be received within the receiving area in a stowed position.

2. An inspection vehicle according to claim 1, wherein the independently driven magnetic wheels on the front chassis are offset from one another, and wherein the independently driven magnetic wheels on the rear chassis are offset from one another.

3. An inspection vehicle according to claim 2, further comprising an auto-orientation circuit configured to automatically orient the inspection vehicle to a set orientation.

4. An inspection vehicle according to claim 3, further comprising a pneumatic delivery system configured to output compressed air adjacent a surface of each wheel.

5. An inspection vehicle according to claim 3, further comprising a pneumatic delivery system configured to continuously output compressed air adjacent a surface of each wheel during movement of the inspection vehicle.

6. An inspection vehicle according to claim 4, wherein the pneumatic delivery system comprises a pneumatic connector, a pneumatic manifold to distribute the pneumatic gas, and a pneumatic path to each of the one or more openings disposed adjacent each wheel.

7. An inspection vehicle according to claim 1, wherein the dimensional envelope of the front chassis, rear chassis, connecting member, and pan and tilt inspection camera assembly is no greater than 8.00"×4.90"×2.00" when the camera assembly is disposed within the receiving area in a stowed position.

8. An inspection vehicle according to claim 1, wherein the dimensional envelope of the pan and tilt inspection camera assembly is no greater than 4.90"×3.35"×1.33" when the camera assembly is disposed within the receiving area in a stowed position.

9. An inspection vehicle according to claim 1, wherein the connecting member is a hinge.

10. An inspection vehicle, the inspection vehicle comprising:

a front chassis comprising two independently driven magnetic wheels, wherein the magnetic wheels are offset from one another;

a rear chassis comprising two independently driven magnetic wheels, wherein the magnetic wheels are offset from one another;

a hinge flexibly connecting the front chassis to the rear chassis to permit relative angular motion between the front chassis and the rear chassis, the connecting member, front chassis, and rear chassis collectively defining a receiving area;

a pan and tilt inspection camera assembly comprising a first rotatable arm driven by a first motor, a second rotatable arm disposed on a distal portion of the first rotatable arm, the second rotatable arm being driven by a second motor, and an inspection camera rotatably disposed on a distal portion of the second arm, the inspection camera being driven by a third motor, the camera assembly being dimensioned to be received within the receiving area in a stowed position; and an auto-orientation circuit configured to automatically orient the inspection vehicle to a set orientation.

11. An inspection vehicle according to claim 10, further comprising a pneumatic delivery system configured to output compressed air adjacent a surface of each wheel.

12. An inspection vehicle according to claim 10, further comprising a pneumatic delivery system configured to continuously output compressed air adjacent a surface of each wheel during movement of the inspection vehicle.

13. An inspection vehicle according to claim 11, wherein the pneumatic delivery system comprises a pneumatic connector, a pneumatic manifold to distribute the pneumatic gas, and a pneumatic path to each of the one or more openings disposed adjacent each wheel.

14. An inspection vehicle according to claim 10, wherein the dimensional envelope of the front chassis, rear chassis, connecting member, and pan and tilt inspection camera assembly is no greater than 8.00"×4.90"×2.00" when the camera assembly is disposed within the receiving area in a stowed position.

15. An inspection vehicle according to claim 12, wherein the dimensional envelope of the pan and tilt inspection camera assembly is no greater than 4.90"×3.35"×1.33" when the camera assembly is disposed within the receiving area in a stowed position.

16. A method for inspecting a secondary side of a steam generator, comprising the acts of:

inserting through a handhole on the secondary side of the steam generator an inspection vehicle, the inspection vehicle comprising a front chassis comprising two independently driven magnetic wheels, a rear chassis comprising two independently driven magnetic wheels, a hinge flexibly connecting the front chassis to the rear chassis to permit relative angular motion between the front chassis and the rear chassis, a receiving area defined by the connecting member, the front chassis, and the rear chassis, a pan and tilt inspection camera assembly comprising a first rotatable arm driven by a first motor, a second rotatable arm disposed on a distal portion of the first rotatable arm, the second rotatable arm being driven by a second motor, and an inspection camera rotatably disposed on a distal portion of the second arm and driven by a third motor, the camera assembly being dimensioned to be received within the receiving area in a stowed position, and an auto-orientation circuit configured to automatically orient the inspection vehicle to a set orientation;

moving the inspection vehicle to an initial row of U-tubes;

panning the inspection camera between the tubesheet and the flow distribution baffle to inspect the tubesheet, U-tubes, and flow distribution baffle;

moving the inspection vehicle forward one row to a next row of U-tubes;

panning the inspection camera between the flow distribution baffle and the tubesheet to inspect the tubesheet, U-tubes, and flow distribution baffle; and sequentially repeating the acts of moving and panning.

17. A method for inspecting a secondary side of a steam generator according to claim 16, wherein the acts of panning comprise the act of viewing peripheral U-tubes of a tube bundle and the act of viewing interior U-tubes of the tube bundle to a depth of at least three tube columns in-bundle.

18. A method for inspecting a secondary side of a steam generator according to claim 16, further comprising:

using the auto-orientation circuit to sense a deviation from a predetermined orientation of the inspection vehicle; and automatically correcting an orientation of the inspection vehicle to comport with the predetermined orientation.

19. A method for inspecting a secondary side of a steam generator according to claim 16, further comprising:

using the auto-orientation circuit to sense a deviation from a predetermined orientation of the inspection vehicle; and automatically correcting an orientation of the inspection vehicle to comport with the predetermined orientation, in the absence of a forward motion of the inspection vehicle, by selectively driving one or more wheels of the front chassis, one or more wheels of the rear chassis, or a combination of one or more wheels of the front chassis and the rear chassis.

20. A method of performing visual inspection of one or more features or objects in a system to be inspected, the method comprising the acts of:

disposing the inspection vehicle on a surface proximate to the one or more features or objects, the inspection vehicle comprising a front chassis comprising two independently driven magnetic wheels, a rear chassis comprising two independently driven magnetic wheels, a hinge flexibly connecting the front chassis to the rear chassis to permit relative angular motion between the front chassis and the rear chassis, a receiving area defined by the connecting member, the front chassis, and the rear chassis, a pan and tilt inspection camera assembly comprising a first rotatable arm driven by a first motor, a second rotatable arm disposed on a distal portion of the first rotatable arm, the second rotatable arm being driven by a second motor, and an inspection camera rotatably disposed on a distal portion of the second arm, the inspection camera being driven by a third motor, the camera assembly being dimensioned to be received within the receiving area in a stowed position, and an auto-orientation circuit configured to automatically orient the inspection vehicle to a set orientation;

moving the inspection vehicle along the surface to a first position relative to the one or more features or objects; and panning the inspection camera to view at least a portion of the one or more features or objects while the inspection vehicle is disposed at the first position.

21. The method for performing visual inspection of one or more features or objects using an inspection vehicle according to claim 20, further comprising:

sequentially repeating the acts of moving and panning to visually inspect the one or more features or objects from a plurality of different positions.

22. The method for performing visual inspection of one or more features or objects using an inspection vehicle according to claim 20, wherein the one or more features or objects are disposed within an enclosure.

23. The method for performing visual inspection of one or more features or objects using an inspection vehicle according to claim 22, wherein the enclosure comprises a vessel or a pipe.

24. The method for performing visual inspection of one or more features or objects using an inspection vehicle according to claim 20, wherein the surface is inclined relative to a horizontal position.

25. The method for performing visual inspection of one or more features or objects using an inspection vehicle according to claim 24, wherein the surface is inclined at an angle of about 90°.

26. The method for performing visual inspection of one or more features or objects using an inspection vehicle according to claim 24, further comprising:

using the auto-orientation circuit to sense a deviation from a predetermined orientation of the inspection vehicle relative to the one or more features or objects; and automatically correcting an orientation of the inspection vehicle to comport with the predetermined orientation.

* * * * *

UNITED STATES PATENT AND TRADEMARK OFFICE

CERTIFICATE OF CORRECTION

PATENT NO. : 8,605,145 B2
APPLICATION NO. : 12/714090
DATED : December 10, 2013
INVENTOR(S) : Webster et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 666 days.

Signed and Sealed this
Sixth Day of October, 2015

Michelle K. Lee

Michelle K. Lee
*Director of the United States Patent and Trademark Office*